United States Patent [19]

Makino et al.

[11] Patent Number: 4,853,322

[45] Date of Patent: Aug. 1, 1989

[54] LIGHT-SENSITIVE SILVER HALIDE EMULSION AND COLOR PHOTOGRAPHIC MATERIALS USING THE SAME

[75] Inventors: Katsumi Makino; Yuichi Ohashi; Hiroshi Takehara; Yoichi Suga; Takekimi Shiozawa, all of Kanagawa, Japan

[73] Assignee: Fuji Photo Film Co., Ltd., Kanagawa, Japan

[21] Appl. No.: 138,267

[22] Filed: Dec. 28, 1987

[30] Foreign Application Priority Data

Dec. 26, 1986 [JP] Japan ..... 61-311130

[51] Int. Cl.[4] ..... G03C 1/02; G03C 1/46

[52] U.S. Cl. ..... 430/567; 430/503; 430/504; 430/569

[58] Field of Search ..... 430/567, 569, 502, 503

[56] References Cited

U.S. PATENT DOCUMENTS

| | | | |
|---|---|---|---|
| 4,150,994 | 4/1979 | Maternaghan | 430/569 |
| 4,301,241 | 11/1981 | Saito | 430/569 |
| 4,414,306 | 11/1983 | Wey et al. | 430/567 |
| 4,414,310 | 11/1983 | Daubendiek et al. | 430/567 |
| 4,433,048 | 2/1984 | Solberg et al. | 430/495 |
| 4,434,226 | 2/1984 | Wilgus et al. | 430/434 |
| 4,439,520 | 3/1984 | Kofron et al. | 430/569 |
| 4,459,353 | 7/1984 | Maskasky | 430/569 |
| 4,686,176 | 8/1987 | Yagi et al. | 430/569 |

OTHER PUBLICATIONS

Bhur et al., Research Disclosure #25330, May 1985.

*Primary Examiner*—Mukund J. Shah

*Attorney, Agent, or Firm*—Sughrue, Mion, Zinn, Macpeak & Seas

[57] ABSTRACT

A light-sensitive silver halide emulsion is disclosed, which comprises light-sensitive silver halide grains in a binder, wherein tabular grains having a diameter of at least 0.15 μm account for at least 70% of the total projected area of said silver halide grains, said tubular grains have a mean aspect ratio of not more than 8.0, and at least 50% (by number) of all of said tabular grains are tabular grains in which the ratio (b/a) of the thickness (b) of said tabular grain to the longest spacing (a) between two or more parallel twinning planes of said tabular grain is at least 5. A color photographic material using the light-sensitive silver halide emulsion for at least one of the silver halide emulsion layers other than the outermost silver halide emulsion layer is also disclosed.

28 Claims, 6 Drawing Sheets

LIGHT-SENSITIVE SILVER HALIDE EMULSION AND COLOR PHOTOGRAPHIC MATERIALS USING THE SAME

FIELD OF THE INVENTION

This invention relates to a light-sensitive silver halide emulsion containing parallel multiple twin silver halide grains having high sensitivity and giving improved graininess. The invention also relates to a silver halide color photographic material suitable for photographing and giving color images having improved sharpness and graininess.

BACKGROUND OF THE INVENTION

Recently, with the progress of high sensitivity and small format of silver halide color negative photographic materials, the development of color negative photographic materials having high sensitivity and giving excellent image quality has been keenly desired.

For this purpose, the requirement for silver halide photographic emulsions has become more and more severe and a higher level of photographic performance such as high sensitivity, high contrast, excellent granularity, high sharpness, etc., has been required.

For such requirements, the technique of using tabular grain silver halide emulsions aiming at the improvement of sensitivity including color sensitization effect by sensitizing dyes, the improvement of the relation between sensitivity and granularity, the improvement of sharpness, and the improvement of covering power is disclosed in U.S. Pat. Nos. 4,434,226, 4,414,310, 4,433,048, 4,414,306, and 4,459,353.

Also, multilayer color photographic materials using a tabular grain silver halide emulsion having an aspect ratio of at least 8:1 for the high-speed emulsion layer and having a high sensitivity, improved graininess, sharpness and color reproducibility are disclosed in Japanese Patent Application (OPI) Nos. 113930/83, 113934/83, and 119350/84 (the term "OPI" as used herein means an "unexamined published patent application").

The above-describedpatents (applications) describe that when a tabular grain silver halide emulsion is used for a blue-sensitive elulsion layer of a multilayer color photographic material, the sharpness is improved since the tabular grain has less light-scattering property and when a tabular grain emulsion is used for a green- or red-sensitive layer, the granularity is also improved.

Japanese Patent Application (OPI) No. 77847/86 discloses a multilayer color photographic material having improved sharpness and color reproducibility by using a tabular grain silver halide emulsion having an aspect ratio of at least 5 for a high-speed emulsion layer and a monodisperse silver halide emulsion for a low-speed layer.

Still further, *Research Disclosure,* No. 25330 discloses a method of controlling the thickness of tabular grains so that the amount of light (sensitive to a silver halide emulsion in an emulsion layer (upper layer) above the emulsion layer using the tabular grains) reflected from the tabular grain emulsion layer is increased to increase the sensitivity of the upper layer or so that the amount of the reflected light is minimized to keep the sharpness of the upper layer.

It has now been found by the inventors' experiments that in spite of such various merits of the tabular grain silver halide emulsion having a high aspect ratio, when in the multilayer structure most generally used for a multilayer color photographic material (i.e., a multilayer structure of a red-sensitive layer, a green-sensitive layer, and a blue-sensitive layer, disposed in this order from the support side), the tabular grain silver halide emulsion having a high aspect ratio (e.g., an aspect ratio of at least 8) is used as a layer other than the layer farthest from the support, in particular, as a green- or red-sensitive layer, the sharpness of the low frequency side is reduced.

For overcoming the reduction in sharpness of the green- or red-sensitive emulsion layer, a silver halide color photographic material containing a tabular grain silver halide emulsion having am aspect ratio of at least 5 in at least one blue-sensitive emulsion layer and also substantially monodisperse non-tabular grains having an aspect ratio of less than 5 in at least one green-sensitive emulsion layer or red-sensitive emulsion layer is proposed in Japanese Patent Application No. 235763/86.

In the proposition, it is said that normal crystal silver halide grains such as tetradecahedral grains are particularly preferred as such a monodisperse non-tabular grain but by the inventors' experiments, it has further been found that the use of such normal crystal grains is yet insufficient with respect to sensitivity and granularity.

This is believed to be due to the fact that although the normal crystal grains have uniform grain sizes and have good granularity as to mean grain size (i.e., as compared to other crystal form grains of the same grain size), the sensitivity as to mean grain size is low.

On the other hand, it has been suggested for a long time that since in tabular grains which are twin grains, and in particular multiple parallel twin grains having a concave incident angle, the concave incident angle is disposed at a position for readily forming a chemical sensitization center, these tabular grains prevent the dispersion of latent images and have high sensitivity as compared to normal crystal grains.

From such a view point, the inventors have started to develop tabular grains which have uniform features such as form, size, etc., like the aforesaid normal crystal grains, have a good relation of sensitivity and granularity, and do not reduce the sharpness at the low frequency side even when they are used for a green- or red-sensitive emulsion layer.

Japanese Patent Application (OPI) Nos. 39027/76, 153428/77, and 142329/80 disclose a production process for multiple parallel twin grains having a monodisperse concave incident angle, but as the result of the inventors' investigations, it has been confirmed that even with these multiple twin crystal grains, a sufficient granularity and sensitivity is not obtained.

By the detailed determination of the spacing between the twin planes of these grains by use of an electron microscope, an X-ray microanalyzer, or the method described hereinafter, it has been found that many defects exist in the grains, the iodine distribution in the grains is broad, and the thickness (b) of the grains and b/a varies in grains, wherein a means the longest distance between two or more parallel twinning planes of a silver halide crystal grain.

This shows that in twin grains which are monodisperse grains in appearance, the features of each grain are not uniform among the grains. Accordingly, the inventors have considered that for obtaining a good relation of granularity and sensitivity, it is necessary that the above-described features of each grain be uniform among the grains.

SUMMARY OF THE INVENTION

A first object of this invention is to provide a light-sensitive silver halide emulsion comprising silver halide grains having parallel twinning planes and having high sensitivity and improved granularity.

A second object of this invention is to improve the sharpness and granularity of the inner silver halide emulsion layers of a multicolor photographic light-sensitive material.

As the result of intensive investigations on the relation of the structure of tabular grains and the photographic performance thereof as described above, the inventors have discovered that the first object of this invention can be attained by the following silver halide emulsion.

That is, the invention is a ligh-sensitive silver halide emulsion comprising light-sensitive silver halide grains in a binder, wherein tabular silver halide grains having a diameter of at least 0.15 μm account for at least 70% of the total projected area of the silver halide grains, a mean aspect ratio of the tabular grains is not more than 8.0, and at least 50% (by number) of all of the tabular grains are tabular grains in which the ratio (b/a) of the thickness (b) of the tabular grain to the longest spacing (a) between two or more parallel twinning planes of the tabular grain is at least 5.

Furthermore, it has also been discovered that the second object of this invention, that is, the improvement of the sharpness and granularity of inner silver halide emulsion layers, such as green- and red-sensitive emulsion layers, of a multilayer color photographic material can be attained by incorporating the above-described silver halide emulsion in at least one of the silver halide emulsion layers other than the silver halide emulsion layer disposed at the farthest position from the support.

DETAILED DESCRIPTION OF THE INVENTION

Figure 1:
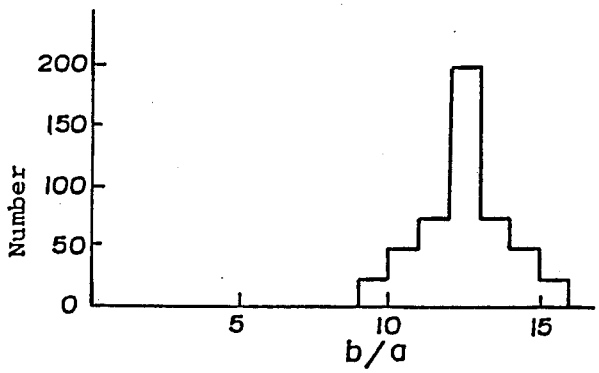
FIG. 1 to FIG. 10 are graphs showing distributions of b/a in Emulsions A to J, respectively, prepared in Example 1.

In this invention, tabular grains are a general term for the grains having one twinning plane or two or more parallel twinning planes. The twinning plane is a (1,1,1) crystal plane when the ions of all lattice points at both sides of the (1,1,1) crystal plane are in a mirror-image relation.

The form of the tabular grain viewed from above is a triangular form, a hexagonal form, or a roundish circular form, and the triangular grain form has triangular outer surfaces which are parallel to each other, the hexagonal grain form has hexagonal parallel outer surfaces, and the circular grain form has circular parallel outer surfaces.

The thickness b of a grain is the distance between the outer surfaces which are parallel to each other. The thickness of a grain can be easily determined by vapor depositing a metal on the grain in an oblique direction together with a latex for reference, measuring the length of the shadow on the electron microphotograph, and calculating the length of the shadow of the latex.

Also, the grain diameter in this invention is a diameter of a circle having the area the same as the projected area of the parallel outer surfaces of the grain.

The projected area of a grain is obtained by measuring the area on the electron microphotograph and correcting for the magnification.

The mean aspect ratio of tabular grains in this invention is the mean value of the values obtained by dividing the diameter of each of tabular grains having a grain long diameter of at least 0.15 μm by the thickness b thereof.

The method of measuring the spacing a between twinning planes in this invention is explained below.

The spacing a of twinning planes is the distance between two twinning planes in the case of grains having two twinning planes in the grain and the longest distance of the distances between each two twinning planes in the case of grains each having three or more twinning planes.

Pratically, by coating a silver halide emulsion composed of tabular silver halide grains on a support, a sample whein tabular grains are disposed on the support almost parallel to the support can be obtained. The sample is cut by a diamond knife to form a piece of about 0.1 μm in thickness. By observing the piece thus obtained with a transmission type electron microscope, the twinning planes of the tabular grains can be detected.

Specifically, electron rays pass through a twinning plane, a phase lag occurs in the electron waves, whereby the existence of twinning planes can be recognized.

The thickness of the twinning planes of tabular grains may also be estimated by referring to the method disclosed in J. F. Hamilton, L. F. Brady, et al., *Journal of Applied Physics,* 35, 414–421 (1964), but the above-described method is more convenient.

In this invention, it is preferred that the tabular grains having a diameter of at least 0.15 μm account for at least 80%, and particularly at least 90% of the total projected area of silver halide grains.

Also, it is preferred that the diameter of the tabular grains is from 0.15 to 5.0 μm, particularly from 0.20 to 20.0 μm, and more particularly from 0.25 to 1.2 μm.

Furthermore, it is preferred that the thickness of the tabular grains is from 0.05 to 1.0 μm, particularly from 0.1 to 0.5 μm, and more particularly from 0.1 to 0.3 μm.

In this invention, the tabular grains having the value of b/a of at least 5 account for at least 50%, preferably at least 70%, and particularly preferably at least 90% of all of the tabular grains having a grain diameter of at least 0.15 μm, preferably of all of silver halide grains contained in the silver halide emulsion. In a particularly preferred embodiment of this invention, the tabular grains have a b/a value of at least 10 and account for at least 50%, particularly at least 70%, and more particularly at least 90% of all of the tabular grains having a grain diameter of at least 0.15 μm.

Furthermore, in this invention, it is preferred that the coefficient of variation of the thickness b of the tabular grains is not more than 20%, the coefficient of variation of the b/a value is not more than 20%, and the coefficient of variation of the grain diameter is not more than 30%.

The coefficient of variation of the thickness b is the value obtained by dividing the standard deviation of thicknesses b by the mean value of bs and multiplying by 100. The coefficient of variaiton of b/a and the coefficient of variation of the grain diameter are defined in an analogous manner to the coefficient of variaition for the thickness b.

For the silver halide photographic emulsion of this invention, silver bromide, silver iodobromide, silver iodochloride, silver chlorobromide, or silver chloride may be used, with silver iodobromide (particularly preferably having iodide content of from 0.1 to 20mol%) being preferred.

The silver halide photographic emulsion of this invention may contain silver halide grains having two or more layer structures, each layer having a substantially different halogen composition, or it may contain silver halide grains having a uniform halogen composition.

In the silver halide emulsion having a layer structure, each layer having a different halogen composition, the silver halide grains may have a high-iodine portion as the core portion and a low-iodine portion as the outermost layer, or the silver halide grains may have a low-iodine portion as the core portion and a high-iodine portion as the outermost layer. Furthermore, the layer structure may be composed of three or more layers and in this case, it is preferred that the outer layer contains lower iodine.

The mean aspect ratio of the tabular grains of this invention is not more than 8.0, preferably not more than 5,0, andmore particularly from 1.1 to 5.0.

The silver halide emulsion, for example, a silver iodobromide emulsion of this invention can be prepared by a precipitation method as described below. That is, a dispersion medium is placed in a reaction vessel for precipitating silver halide equipped with a stirring mechanism. The amount of the dispersion medium placed in the reaction vessel in the initial step is usually at least about 10%, and preferably from 20 to 80%, of the amount of the dispersion medium existing in the emulsion after the final formation step of the precipitation of the silver halide grains.

The dispersion medium placed initially in the reaction vessel is water or an aqueous dispersion of flocculant and the dispersion medium contains, if necessary, other component(s) such as one or more silver halide ripening agents and/or metal doping agents as will be explained below in detail.

In the case of incorporating a flocculant in water at the outset, the concentration thereof is preferably at least 10%, and particularly at least 20% of the total amount of the flocculant existing at the completion of silver halide precipitation. An additional dispersion medium is added to the reaction vessel together with silver and halides salts and can also be introduced through a separate jet.

A minor portion, typically less than 10% by weight of the bromide salt employed for forming the silver iodobromide grains is initially present in the reaction vessel to adjust the bromide ion concentration in the dispersion medium at the outset of silver iodobromide precipitation. Also, the dispersion medium in the reaction vessel is initially substantially free of iodide ions, since the presence of iodide ions prior to the introduction of silver and bromide salts favors the formation of thick and non-tabular grains and also in the tabular grains, spacing of twinning planes, lack of uniformity and distribution of b/a is increased by the operation of the observation method as described hereinafter. As employed herein, the term "substantially free of iodide ions" means that there are insufficient iodide ions present as compared to bromide ions to precipitate as a separate silver iodide phase. It is preferred to maintain the iodide concentration in the reaction vessel prior to the introduction of silver salt, at less than 0.5 mol% of the total halide ion concentration in the reaction vessel. If the pBr of the dispersion medium is initially too high, the tabular iodobromide grains produced become comparatively thick and thus the thickness distribution of the grains and the distribution of b/a are broadened. On the other hand, if the pBr is too low, non-tabular silver iodobromide grains are liable for form.

Therefore, as a result of investigations while observing the spacings of twinning planes of tabular silver iodobromide grains, it has been discovered that by maintaining the pBr in the reaction vessel at or above 0.6 and less than 2.0, preferably at 1.1 or above 1.1 and less than 1.8 in the nucleation stage of grain formation, the distributions of the thickness and b/a are narrowed. The pBr as herein employed is defined as the negative logarithm of the bromide ion concentration.

During the formation of precipitation, silver, bromide, and iodide salts are added to the reaction vessel by the technique well known in the precipitation of silver iodobromide grains. Usually, an aqueous solution of a soluble silver salt such as silver nitrate is introduced into the reaction vessel concurrently with the introduction of the bromide and iodide salts. Also, the bromide and iodide salts are usually introduced as aqueous salt solutions, such as aqueous solutions of soluble ammonium, alkali metal (e.g., sodium or potassium), or alkaline earth metal (e.g., magnesium or calcium) halide salts. The silver salt is at least initially introduced into the reaction vessel separately from the bromide salt and the iodide salt. The bromide and iodide salts can be added separately or as a mixture thereof.

With the introduction of silver salt into the reaction vessel, the nucleation stage of grain formation is initiated. A polulation of grain nuclei are formed which are capable of serving as precipitation sites for silver bromide and silver iodide as the introduction of silver, bromide, and iodide salts continues. The precipitation of silver bromide and silver iodide onto existing grain nuclei constitutes the growth stage of grain formation. It is preferred that the mean value of diameters of circles corresponding to the projected area of tabular grains before entering the grain growth state is not more than 0.6 $\mu$m, particularly not more than 0.4 $\mu$m.

The conditions for the formation of nuclei may be found in Japanese patent application No. 48950/86 but other methods can be employed and, for example, the nuclei-forming temperature may be in the range of from 5° C. to 55° C.

This size distribution of tubular grains produced by the aforesaid method is greatly influenced by the concentrations of the bromide salt in the grain growth stage. If the pBr is too low, tabular grains having a high aspect ratio are formed but the coefficient of variation of the projected area becomes very large. By maintaining the pBr in the range of from about 2.2 to 5, and preferably from about 2.5 to 4, tabular grains having a small coefficient of variation of projected area can be formed.

Subject to the pBr requirements set forth above, the concentrations of silver, bromide, and iodide salt solutions added and the addition rates of the solutions can take any conventional form. The concentrations of the silver and halide salts solutions are preferably from 0.1 to 5 mols per liter, although broader conventional ranges, for example, from 0.01 mol to saturation can be employed. Specifically preferred techniques for precipitation are those which achieve shortened precipitation times by increasing the addition rates of the silver and halide salt solutions. The addition rate can be increased either by increasing the rate at which the dispersion medium and the silver and halide salts are introduced or by increasing the concentrations of the silver and halide salts within the dispersion medium being introduced. Also, the coefficient of variation of the projected area of grains can be further reduced by keeping the addition rate of silver and halide salts at about the limiting value at which the growth of new grain nuclei occurs as described in Japanese patent application (OPI) No. 142329/80.

The temperature at the grain growth stage is preferably from 30° C. to 80° C.

For making uniform b/a, the following must be taken into consideration in addition to the selection of the pBr and temperature at the nuclei formation and grain growth stages as described above.

The amount of gelatin present in the reaction vessel at nuclei formation has a very large influence on the grain size distribution. If the gelatin amount is not most suitably selected, the nuclei formation becomes ununiform and according to the observation of the twinning planes by the aforesaid method, b/a is greatly dispersed among grains. The concentration of gelatin is preferably from 0.5 to 10% by weight, and more preferably from 0.5 to 6% by weight.

Also, the rotation speed of the stirrer and the form of the reaction vessel influence the distribution of grain size and the distribution of b/a.

As the reaction vessel equipped with a stirrer, the apparatus wherein reaction liquids are added into liquid and stirred as described in U.s. Pat. No. 3,785,777 is preferred and a too large or too small rotation speed of the stirrer is not preferred. If the rotation speed is too low, the formation ratio of non-tabular twin grains is increased and if the rotation speed is too high, the formation frequency of tabular grains is reduced and the size distribution is broadened.

Also, a reaction vessel having a semi-spherical bottom is most preferred.

As described hereinbefore, the sharpness and graininess of green- and/or red-sensitive emulsion layers of a color photographic material can be attained by using the above-described silver halide photographic emulsion for at least one of the green-sensitive layers and/or at least one of the red-sensitive layers.

The silver halide color photographic material of this invention has a multilayer structure of plural emulsion layers containing binder and silver halide grains, separately recording blue, green, and red lights, respectively, and each emulsion layer is composed of at least two layers of a high-speed emulsion layer and a low-speed emulsion layer. Particularly useful layer structures are as follows.

(1) BH/BL/GH/GL/RH/RL/S,
(2) BH/BM/BL/GH/GM/GL/RH/RM/RL/S,
(3) BH/BL/GH/RH/GL/RL/S as described in U.S. Pat. No. 4,184,876, and
(4) BH/GH/RH/BL/GL/RL/S as described in *Research Disclosure,* No. 22534, Japanese patent application (OPI) Nos. 177551/84, 177552/84, etc.

In the aforesaid layer structures, B represents a blue-sensituve emulsion layer, G a green-sensitive emulsion layer, R a red-sensitive emulsion layer, H a highest speed emulsion layer, M an intermediate speed emulsion layer, L a low speed emulsion layer, and S a support. The color photographic material of this invention has further light-insensitive layers such as protective layer(s), a filter layer, intermediate layers, antihalation layer(s), subbing layer(s), etc., in addition to the light-sensitive emulsion layers but they are deleted in the above examples.

In the above-described layer structures, structures (1), (2) and (4) are preferred.

Also, (5) BH/BL/CL/GH/GL/RH/RL/S and
(6) BH/BL/GH/GL/CL/RH/RL/S, which are described in Japanese patent application (OPI) No. 34541/86 are also preferred.

In the above layer structure, CL is an inter-layer effect imparting layer.

In layer structure (1), the silver halide emulsion of this invention is used for at least one layer of BL, GH, GL, RH, and RL and in this case, it is preferred that the silver halide emulsion of this invention having an aspect ratio of from 5 to 8 is used for BL and the silver halide emulsion of this invention having an aspect ratio of not higher than 5 for GH, GL, RH, and/or RL.

Furthermore, it is preferred to use the silver halide emulsion of this invention having an aspect ratio of not more than 5 for all layers of GH, CL, RH, and RL, and also it is preferred that a monodisperse silver halide emulsion as disclosed in Japanese patent application No. 157656/86 is used for BH.

Also, in the case of layer structure (5), it is preferred that the silver halide emulsion of this invention is also used for CL.

In the case of layer structure (6), it is preferred to use the silver halide emulsion of this invention having an aspect ratio of not higher than 5 in the silver halide emulsions of this invention for CL.

The silver halide emulsions for use in layers other than the CL layer in layer structures (5) and (6) are the same as in the case of layer structure (1).

The silver halide emulsion of this invention can be most effectively used for other layers than the outermost layers of the color photographic light-sensitive material as described above but can be used for other light-sensitive materials, such as radiographic photographic materials, black-and-white photographic films, photographic light-sensitive materials for printing, photographic papers, etc.

The silver halide emulsions of this invention may contain various additives such as binders, chemical sensitizers, spectral sensitizers, stabilizers, gelatin hardening agents, surface active agents, antistatic agents, polymer latexes, matting agents, color couplers, ultraviolet absorbents, fading preventing agents, dyes, etc. Also, there is no particular restriction on the supports and coating methods for coating the silver halide emulsions. Also, any light-exposure methods and processing methods for the color photographic materials of this invention can be used without restriction.

The additives, etc., which can be used for the color photographic materials of this invention are described, e.g., in *Research Disclosure,* Vol. 176, Item 17643 (RD- 17643), ibid, Vol. 187, Item 18716 (RD-18716), and ibid, Vol. 225, Item 22534 (Rd-22534).

These descriptions in the Research Disclosures are summarized below.

| No. | Kind of Additives | RD 17643 | RD 18716 | RD 22534 |
|---|---|---|---|---|
| 1. | Chemical sensitizer | page 23 | page 648, right column | page 24 |
| 2. | Sensitivity increasing agent | — | " | — |
| 3. | Spectral sensitizer and Supersensitizer | pages 23–24 | page 648, right column to page 649, right column | pages 24 and 28 |
| 4. | Whitening agent | page 24 | — | — |
| 5. | Antifoggant and Stabilizer | pages 24–25 | page 649, right column | pages 24 and 30 |
| 6. | Light absorber, Filter dye, and Ultraviolet absorbent | pages 25–26 | page 649, right column to page 650, left column | — |
| 7. | Stain preventing agent | page 25, right column | page 650, left to right columns | — |
| 8. | Color image stabilizer | page 25 | — | page 32 |
| 9. | Hardening agent | page 26 | page 651, left column | page 28 |
| 10. | Binder | page 26 | " | — |
| 11. | Plasticizer and Lubricant | page 27 | page 650, right column | — |
| 12. | Coating aid and Surfactant | pages 26–27 | " | — |
| 13. | Antistatic agent | page 27 | " | — |
| 14. | Color coupler | page 25 | page 649 | page 31 |

It is preferred that color couplers for use in this invention are rendered nondiffusible by having a ballast group or being polymerized. Furthermore, the use of 2-equivalent color couplers the coupling active position of which is substituted by a releasing group is more effective for reducing the amount of silver than the case of using 4-equivalent color couplers having a hydrogen atom at the coupling active position thereof. Couplers providing colored dyes having a proper diffusibility, non-coloring couplers, DIR couplers releasing a development inhibitor with the coupling reaction or couplers releasing a development accelerator with the coupling reaction thereof can be used for the color photographic materials of this invention.

Typical examples of the yellow couplers for use in this invention are oil-protect type acylacetamide series yellow couplers. Specific examples of the couplers are described in U.S. Pat. Nos. 2,407,210, 2,875,057, 3,265,506, etc.

In this invention, 2-equivalent yellow couplers are preferably used and typical examples thereof are oxygen atom-releasing type yellow couplers described in U.S. Pat. Nos. 3,408,194, 3,447,928, 3,933,501, 4,022,620, etc., and nitrogen atom-releasing type yellow couplers described in Japanese Patent Publication No. 10739/83, U.S. Pat. Nos. 4,401,752 and 4,326,024, *Research Disclosure,* No. 18053 (April, 1979), British Pat. No. 1,425,020, West German patent application (OLS) Nos. 2,219,917, 2,261,3261, 2,329,587, 2,433,812, etc. In these couplers, α-pivaloylacetanilide series yellow couplers are excellent in fastness, in particular, light fastness of the colored dyes formed, while α-benzoylacetanilide series yellow couplers give high coloring density.

As the magenta couplers for use in this invention, there are oil-protect type indazolone series or cyanoacetyl series magenta couplers, preferably 5-pyrazolone series couplers and pyrazoloazole series couplers such as pyrazolotriazole series couplers.

The 5-pyrazolone series couplers having an arylamino group or an acylamino group at the 3-position thereof are preferred from the viewpoint of the hue of the colored dyes and the coloring density, and typical examples of the couplers are described in U.S. Pat. Nos. 2,311,082, 2,343,703, 2,600,788, 2,908,573, 3,062,653, 3,152,896, 3,936,015, etc. Preferred releasing groups for the 2-equivalent 5-pyrazolone series magenta couplers include nitrogen atom-releasing groups described in U.S. Pat. No. 4,310,619 and arylthio groups described in U.S. Pat. No. 4,351,897. Also, 5-pyrazolone series magenta couplers having a ballast group described in European Pat. No. 73,636 give high coloring density.

Pyrazoloazole series magenta couplers include pyrazolobenzimidazoles described in U.S. Pat. No. 3,061,432, preferably pyrazolo[5,1-c][1,2,4]triazoles described in U.S. Pat. No. 3,725,067, pyrazolotetrazoles described in *Research Disclosure,* No. 24220 (June, 1984), Japanese patent application (OPI) No. 33552/85, and pyrazolopyrazoles described in *Research Disclosure,* No. 24230 (June, 1984), and Japanese patent application (OPI) No. 43659/85. From the viewpoint of giving less yellow absorption of colored dyes and high light fastness of color dyes, imidazo[1,2-b]pyrazoles described in U.S. Pat. No. 4,500,630 are preferred and pyrazolo[1,5-b][1,2,4]triazoles described in U.S. Pat. No. 4,540,654 are particularly preferred.

Cyan couplers for use in this invention include oil-protect type naphtholic and phenolic couplers.

The naphtholic cyan couplers include naphtholic couplers described in U.S. Pat. No. 2,474,293 and, preferably oxygen atom-releasing type 2-equivalent naphtholic couplers described in U.S. Pat. Nos. 4,052,212, 4,146,396, 4,228,233, and 4,296,200. Also, specific examples of the phenolic cyan couplers are described in U.S. Pat. Nos. 2,369,929, 2,801,171, 2,772,162, 2,895,826, etc. Cyan couplers having high fastness to moisture and heat are preferably used in this invention, and typical examples thereof are the phenolic cyan couplers having an alkyl group of two or more carbon atoms at the meta-position of the phenol nucleus described in U.S. Pat. No. 3,772,002, 2,5-diacylamino-substituted phenolic cyan couplers described in U.S. Pat. Nos. 2,772,162, 3,758,308, 4,126,396, 4,334,011 and 4,327,173, West German patent application (OLS) No. 3,329,729, European Pat. No. 121,365, etc., and phenolic cyan couplers having a phenylureido group at the 2-position and acylamino group at the 5-position thereof described in U.S. Pat. Nos. 3,446,622, 4,333,999, 4,451,559, 4,427,767, etc. The cyan couplers having a sulfonamido group, an amido group, etc., at the 5-position of the naphthol nucleus described in Japanese patent application (OPI) Nos. 237448/85, 153640/86, and 145557/86 are excellent in fastness of the color images formed and are preferably used in this invention.

For color photographic negative films for photographing, it is preferred to use colored couplers together with the above-described color couplers for correcting unnecessary absorption at the long wavelength side by the dyes formed from magenta couplers and cyan couplers. Typical examples of the colored couplers are yellow-colored magenta couplers described in U.S. Pat. No. 4,163,670 and Japanese Patent Publication No. 39413/82 and magenta-colored cyan couplers described in U.S. Pat. Nos. 4,004,929, 4,138,258, and British Pat. No. 1,146,368.

In this invention, the graininess of color images formed can be improved by using couplers giving a colored dye having a proper diffusibility together with the aforesaid couplers. About such couplers giving diffusible dyes, specific examples of the magenta couplers are described in U.S. Pat. No. 4,366,237 and British Pat. No. 2,125,570 and specific examples of the yellow, magenta and cyan couplers are described in European Pat. No. 96,570 and German patent application (OLS) No. 3,234,533.

The dye-forming couplers and the specific couplers described above may form a dimer or higher polymer. Typical examples of the polymerized dye-forming couplers are described in U.S. Pat. Nos. 3,451,820 and 4,080,211. Also, specific examples of the polymerized magenta couplers are described in British Pat. No. 2,102,173, U.S. Pat. No. 4,367,282, Japanese patent application (OPI) No. 232455/86, and Japanese patent application No. 113596/85.

The color photographic materials of this invention may further contain so-called DIR couplers releasing a development inhibitor with development.

As DIR couplers, there are the couplers releasing a heterocyclic mercapto series development inhibitor described in U.S. Pat. No. 3,227,554; the couplers releasing a benzotriazole derivative as a development inhibitor described in Japanese Patent Publication No. 9942/83; the so-called non-coloring DIR couplers described in Japanese Patent Publication No. 16141/76; the couplers releasing a nitrogen-containing heterocyclic development inhibitor accompanied by the decomposition of methylol after the release thereof described in Japanese patent application (OPI) No. 90932/77; the couplers releasing a development inhibitor accompanied by an intramolecular nucleating reaction after release thereof described in U.S. Pat. No. 4,248,962 and Japanese patent application (OPI) No. 56837/82; the couplers releasing a development inhibitor by an electron transfer through a covalent system after relese thereof described in Japanese patent application (OPI) Nos. 114946/81, 154234/82, 188035/82, 98728/83, 209736,83, 209737/83, 209738/83, 209739/83, 209740/83, etc.; the couplers releasing a diffusible development inhibitor the development inhibiting faculty of which is inactivated in the color developer described in Japanese patent application (OPI) Nos. 151944/82, 217932/83, etc.; the couplers releasing a reactive compound to form a development inhibitor by a reaction with the layer at development or to inactivate the development inhibitor described in Japanese patent application (OPI) Nos. 182438/85, 184248/85, etc.

In the DIR couplers described above, the developer inactivation type couplers typified by Japanese patent application (OPI) No. 151944/82; the timing type couplers described in U.S. Pat. No. 4,248,,962 and Japanese patent application (OPI) No. 154232/82; and the reaction type couplers described in Japanese patent application (OPI) No. 184248/85 are more preferred in the combination with the present invention. In the aforesaid couplers, the development inactivation type DIR couplers described in Japanese patent application (OPI) Nos. 218644/85, 151944/82, 217932/83, 225156/85, 233650/85, etc., and the reaction type DIR couplers described in Japanese patent application (OPI) No. 184248/85 are particularly preferred.

For the color photographic materials of this invention, compounds imagewise releasing a nucleating agent or a development accelerator or a precursor thereof (hereinafter, referred to as "development accelerator, etc.") at development can be used. Typical examples of the aforesaid compounds are DAR couplers, i.e., the couplers releasing a development accelerator by a coupling reaction with the oxidation product of an aromatic primary amine developing agent, as described in British Pat. Nos. 2,097,140 and 2,131,188.

It is preferred that the development accelerator, etc., released from the DAR couplers have an absorptive property for silver halide and specific examples of such a DAR coupler are described in Japanese patent application (OPI) Nos. 157638/84 and 170840/84. The DAR coupler releasing an N-acyl-substituted hydrazine having a mono- or fused-heterocyclic group as the absorbing group, at the sulfur atom or nitrogen atom from the coupling active position of the coupler is particularly preferred and specific examples of the coupler are described in Japanese Patent Application (OPI) No. 128446/85.

For dispersing color couplers described above in an aqueous medium, a high-boiling organic solvent can be used. Specific examples of the organic solvent are phthalic acid esters (e.g., dibutyl phthalate, dicyclohexyl phthalate, di-2-ethylhexyl phthalate, decyl phthalate, etc.), phosphoric acid esters or phosphonic acid esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, etc.), benzoic acid esters (e.g., 2-ethylhexyl benzoate, dodecyl benzoate, 2-ethylhexyl-p-hydroxy benzoate, etc.), amides (e.g., diethyldodecanamide, N-tetradecylpyrrolidone, etc.), alcohols or phenols (e.g., isostearyl alcohol, 2,4-di-tert-amylphenol, etc.), aliphatic carboxylic acid esters (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc.

Also, organic solvents having a boiling point of at least about 30° C., preferably from about 50° C. to about 160° C. can be used as auxiliary solvents in this invention. Specific examples of these solvents are ethyl acetate, butyl acetate, ethyl propionate, methyl ethyl ketone, cyclohexanone, 2-ethoxyethyl acetate, dimethylformamide, etc.

The color photographic materials of this invention may further contain various kinds of components for preventing the formation of fog during the production, storage, and/or processing thereof or stabilizing the photographic performance. Examples of these compounds are azoles such as benzothiazolium salts, benzimidazolium salts, imidazoles, benzimidazoles (preferably 5-nitrogenzimidazoles), nitroindazoles, benzotriazoles (preferably 5-methylbenzotriazoles), triazoles, etc.; mercapto compounds such as mercaptothiazoles, mercaptobenzothiazoles, mercaptobenzimidazoles, mercaptobenzoxazoles, mercaptoxadiazoles, mercaptothiadiazoles, mercaptotriazoles, mercaptotetrazoles (in particular, 1-phenyl-5-mercaptotetrazole, etc.), mercaptopyrimidines, mercaptotriazines, etc.; thiocarbonyl compounds such as oxazolinethione, etc.; azaindenes such as triazaindenes, tetraazaindenes (in particular, 4-hydroxy-6-methyl-(1,3,3a,7)tetraazaindene), pentaazaindenes, etc.; benzenethiosulfonic acids; benzenesulfinic acids; benzenesulfonic acid amides; purines such as adenine, etc.; which are known as antifoggants or stabilizers.

As a gelatin hardening agent which can be used for the color photographic material of this invention, active halogen compounds (2,4-dichloro-6-hydroxy-1,3,5-triazine, the sodium salt thereof, etc.), active vinyl compounds (1,3-bisvinylsulfonyl-2-propanol, 1,2-bis(vinylsulfonylacetamido)ethane, a vinylic polymer having a vinylsulfonyl group at the side chain, etc.), etc, can be preferably used since they harden quickly hydrophilic colloids such as gelatin to give stable photographic properties. Also, N-carbamoylpyridinium salts (1-morpholinocarbonyl-3-pyridinio)methanesulfonate, etc.) and haloamidinium salts (1-(1-chloro-1-pyridinomethylene)pyrrolidinium-2-naphthalene sulfonate, etc.) have high hardening rates and can be preferably used in this invention.

The invention will now be explained by reference to the following examples which are not intended to be limiting.

Unless otherwise specified, all percents, ratios, etc. are by weight.

EXAMPLE 1

Emulsion A (Step A): In a 4-liter reaction vessel was placed an aqueous gelatin solution (composed of 1350 ml of water, 17 g of gelatin and 3.7 g of potassium bromide, pH adjusted to 6.0 with 1.2 ml of an aqueous solution of potassium hydroxide, pBr 1.47), and after simultaneously adding thereto 67.7 ml of an aqueous silver nitrate solution containing 0.90 mol/liter of silver nitrate and 67.7 ml of an aqueous solution containing 0.85 mol/liter of potassium bromide and 0.04 mol/liter of potassium iodide at constant volumes over a period of 45 seconds while maintaining the solution at 45° C., the resultant mixture was allowed to stand for 5 minutes. Then, the temperature of the mixture was raised to 65° C. and after adding thereto 241 g of an aqueous 10% solution, the resultant mixture was allowwed to stand for 30 minutes.

(Step b): Thereafter, an aqueous solution containing 1.76 mol/liter of silver nitrate and an aqueous solution of 72 mol/liter of potassium bromide and 0.056 mol/liter of potassium iodide were added by a double jet method while accelerating the flow rate (the flow rate at the end of the addition was twice the flow rate at the initiation of the addition) and maintaining the pBr at 3.6 over a period of 60 minutes until the consumed amount of the aqueous silver nitrate solution became 655 ml.

After finishing precipitation, the silver halide emulsion thus formed was cooled to 40° C., 1.65 liters of an aqueous solution of 15.3% phthalated gelatin was added to the emulsion, and then the emulsion was washed twice by the coagulation method described in U.S. Pat. No. 2,614,929. Then, 0.55 liter of an aqueous solution of 10.5% bone gelatin was added to the emulsion and then the pH and pBr were adjusted to 5.5 and 3.1, respectively at 40° C.

The silver halide grains thus obtained were tabular silver halide grains containing 2 mol% iodine in all, having a mean grain diameter of 0.7 μm, and a mean aspect ratio of 2.0.

By viewing the sectional photograph of the grain by the method described hereinbefore, the twinning planes thereof could be observed. The value of a was 0.03 μm, which was almost the same as the thickness of the tabular grain at the completion of Step a and b/a was about 12.

Emulsion B

By following the same procedure as in the preparation method for Emulsion A except that the amount of potassium bromide in the aqueous gelatin solution initially existing in the reaction vessel was changed from 3.7 g to 4.2 g and the amount of gelatin in the solution was changed from 17 g to 21 g, Emulsion B was prepared.

Emulsion C

By following the same procedure as in the preparation method for Emulsion A except that the amount of potassium bromide in the aqueous gelatin solution initially existing in the reaction vessel was changed from 3.7 g to 5.2 g and the amount of gelatin in the solution was changed from 17 g to 26 g, Emulsion C was prepared.

Emulsion D

By following the same procedure as in the preparation method for Emulsion A except that the amount of potassium bromide in the aqueous gelatin solution initially existing in the reaction vessel was changed from 3.7 g to 7.5 g and the amount of gelatin in the solution was changed from 17 g to 32 g, Emulsion D was prepared.

Emulsion E

By following the same procedure as in the preparation method for Emulsion A except that the amount of potassium bromide in the aqueous gelatin solution initially existing in the reaction vessel was changed from 3.7 g to 12 g and the amount of gelatin in the solution was changed from 17 g to 40 g, Emulsion E was prepared.

Emulsion F

By following the same procedure as in the preparation method for Emulsion B except that 19 g of potassium iodide was newly added to the aqueous gelatin solution initially existing in the reaction vessel, Emulsion F was prepared.

Emulsion G

By following the same procedure as in the preparation method for Emulsion B except that 3 g of potassium iodide was newly added to the aqueous gelatin solution initially existing in the reaction vessel, Emulsion G was prepared.

Emulsions H and I

By following the same procedures as in the preparation methods for Emulsions A and B, except that the value of the pBr in Step b was changed from 3.6 to 2.6, Emulsions H and I were prepared, respectively.

Emulsion J

By following the same procedures as in the preparation method for Emulsion G except that the value of the pBr in Step b was changed from 3.6 to 2.0, Emulsion J was prepared.

Emulsion K (Seed Crystal): In a 4-liter reaction essel was placed an aqueous gelatin solution (composed of 1 liter of water, 45 g of gelatin, and 0.3 g of potassium bromide) and then an aqueous solution containing 3.43 mol/liter of potassium bromide and 0.07 mol/liter of potassium iodide and an aqueous solution of 3.5 mol/liter of silver nitrate were added thereto by a double jet method at pH of 5.6 and 70° C. while maintaining the pBr at 2.3 until 1 liter of aqueous silver nitrate solution was consumed. The solution of the halides and the solution of silver nitrate were added in a stepwise manner by the technique described in German Patent Application (OLS) No. 2,107,118. That is, from the initiation of additions to the completion thereof, the addition rate was increased in 7 steps of 19.65 ml/min., 45.20 ml/min., 78.6 ml/min., 123.80 ml/min., 176 ml/min., 241.70 ml/min., and 314.4 ml/min., every 4 minutes.

After forming precipitations, 0.2 liter of an aqueous solution of 10% phthalated gelatin was added to the silver halide emulsion at 40° C. and the emulsion was washed twice according to the coagulation method described in U.S. Pat. No. 2,614,929. Thereafter, 1.0 liter of an aqueous solution of 10.5% bone gelatin was added to the emulsion and then the pH and pBr of the emulsion were adjusted to 5.5 and 3.1, respectively at 40° C.

(Growth): In a 4-liter reaction vessel was placed 1 liter of an aqueous gelatin solution (3.75% phthalated gelatin) and after adding thereto 279 g (0.3 mol) of the seed crystals formed above, the mixture was stirred at a pH of 5.8. Then, an aqueous solution containing 3.43 mol/liter of potassium bromide and 0.07 mol/liter of potassium iodide and an aqueous solution containing 3.5 mol/liter of silver nitrate were added thereto by a double jet method at 70° C. while maintaining the pAg at 8.3 until 0.931 liter of aqueous silver nitrate was consumed. The solution of the halides and the solution of silver nitrate were added in a stepwise manner according to the technique described in German Patent Application (OLS) No. 2,107,118. That is, from the initiation of the additions to the completion thereof, the flow rate thereof was increased in steps of 18.5 ml/min., 22.2 ml/min., 27.7 ml/min., 33.3 ml/min., 37.0 ml/min., 44.3 ml/min., and 49.9 ml/min., every 4 minutes.

After the formation of precipitates, 0.37 liter of an aqueous 10% phthalated gelatin solution was added to the emulsion at 40° C. and then the emulsion was washed twice according to the coagulation method described in U.S. Pat. No. 2,614,929.

Then, 1.0 liter of an aqueous solution of 10.5% bone gelatin was added to the emulsion and then the pH and pBr of the emulsion were adjusted to 5.5 and 3.1, respectively at 40° C. to provide Emulsion K.

The emulsions thus prepared are summarized in Table 1 below.

Also, the distributions of b/a among the grains of Emulsions A to J are also shown in FIGS. 1 to 10, respectively, wherein the abcissa stands for b/a and the ordinate stands for the number frequency.

The observation of sectional photographs of these grains were performed in the following manner. Each coated sample of the emulsion, wherein tabular grains were disposed in parallel to the support, was cut by a diamond knife to form a piece of about 0.1 μm in thickness and each piece was observed with a transmission type electron microscope to detect twinning planes of twin crystals.

Figure 13:
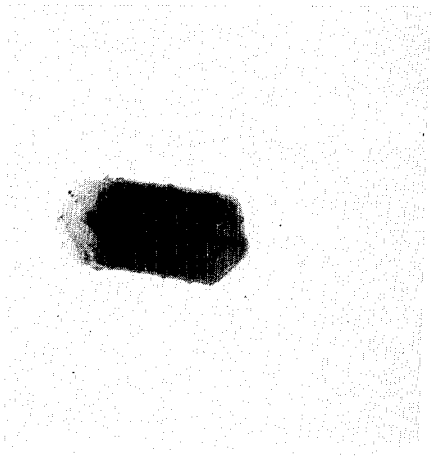
FIG. 13 is a transmission-type electron micrograph at a magnification of 50,000 showing the sectional surface of a grain of Emulsion A.
Figure 14:
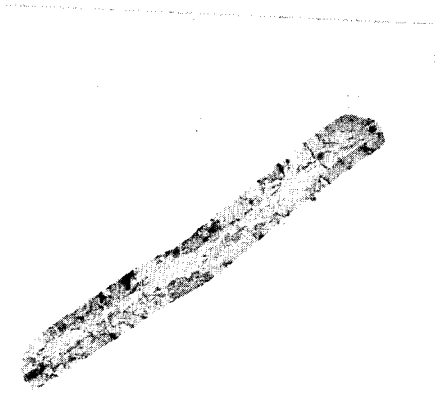
FIG. 14 is a transmission-type electron micrograph at a magnification of 12,000 showing the sectional surface of a grain of Emulsion J.

The electron microphotographs were taken and the spacing a between twinning planes and the thickness b of the grains were measured on the photographs, and b/a was calculated (see FIGS. 13 and 14).

TABLE 1

Figure 2:
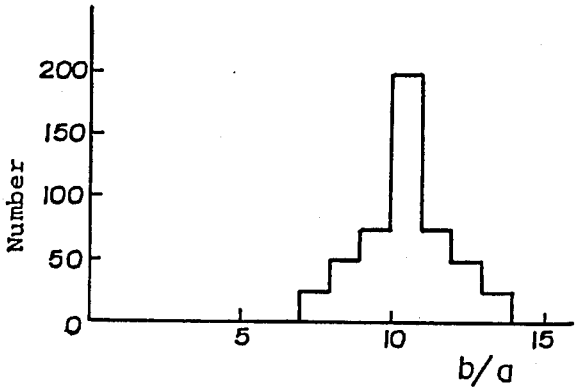
Figure 3:
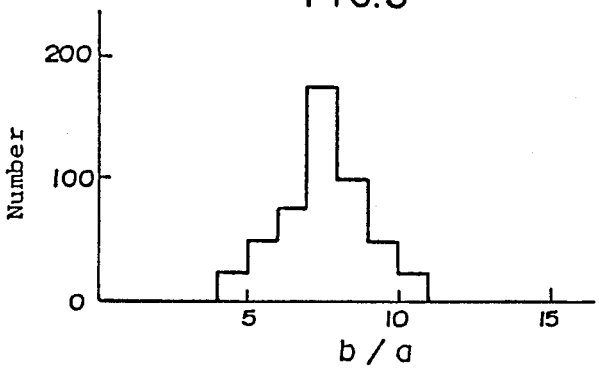
Figure 4:
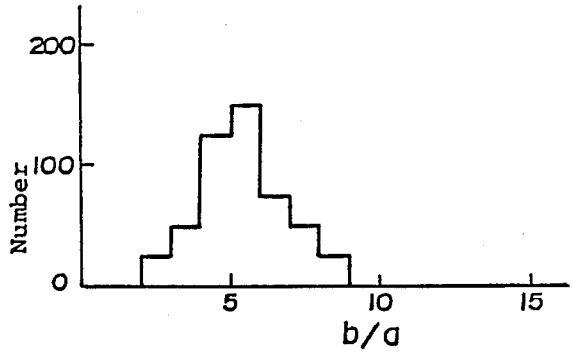
Figure 5:
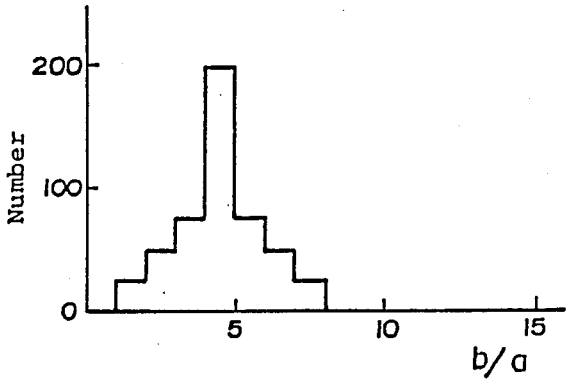
Figure 6:
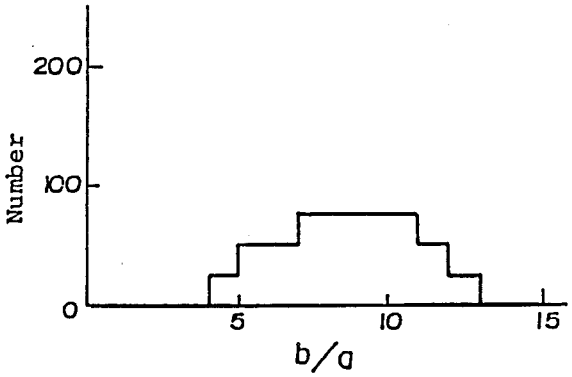
Figure 7:
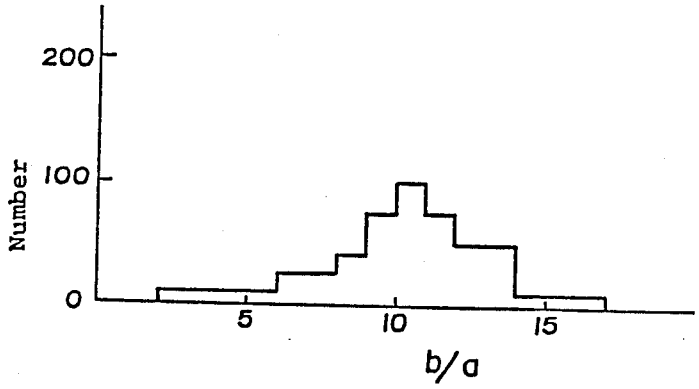
Figure 8:
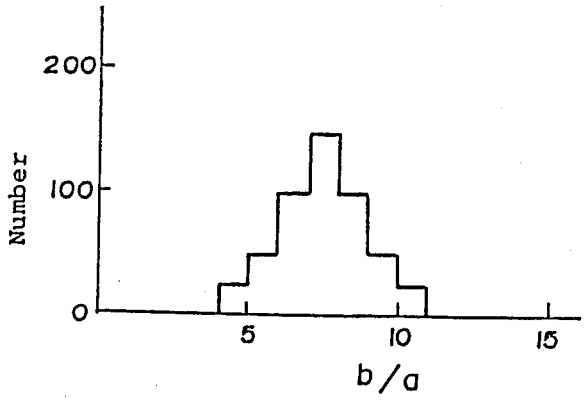
Figure 9:
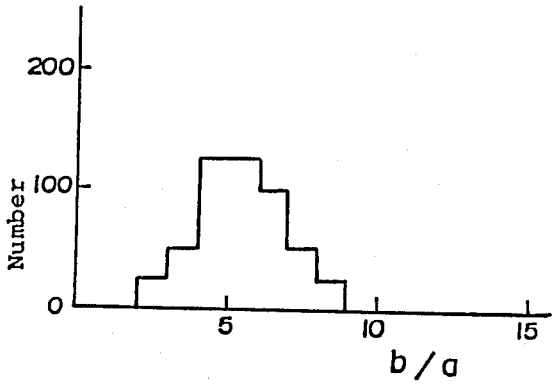
Figure 10:
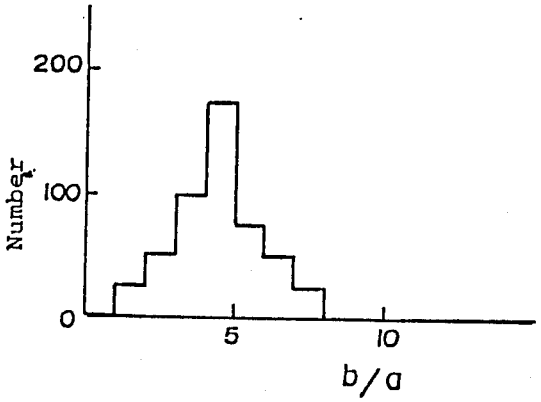
Figure 11:
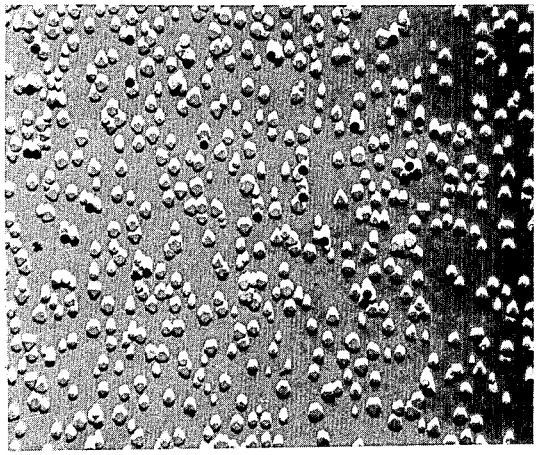
FIGS. 11 and 12 are electron microphotographs at a magnification of 3,000 of the silver halide grains of Emulsions A and J, respectively.
Figure 12:
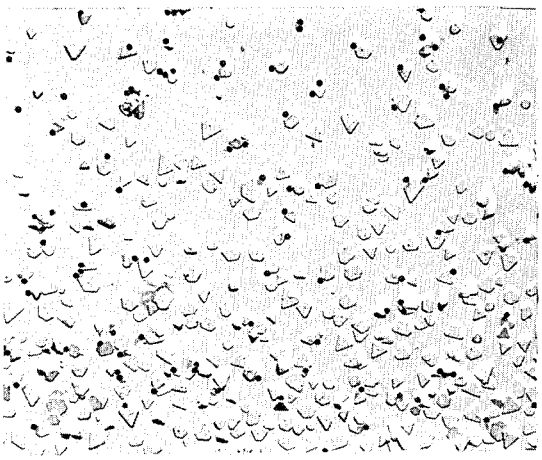

| Emulsion | Iodine Content | Iodine Structure | Distribution of b/a | Ratio of Grains of b/a ≧ 5 | Ratio of Grains of b/a ≧ 10 | Mean Aspect Ratio |
|---|---|---|---|---|---|---|
| Em A | 2 | Uniform AgI Type | FIG. 1 | 100% | 95% | 2 |
| B | " | " | FIG. 2 | 100% | 60% | 2 |
| C | " | " | FIG. 3 | 95% | 5% | 2 |
| D | " | " | FIG. 4 | 60% | 0% | 2 |
| E* | " | " | FIG. 5 | 30% | 0% | 2 |
| F | " | " | FIG. 6 | 95% | 30% | 2 |
| G | " | " | FIG. 7 | 95% | 60% | 2 |
| H | " | " | FIG. 8 | 95% | 5% | 2 |
| I | " | " | FIG. 9 | 60% | 0% | 6 |
| J* | " | " | FIG. 10 | 30% | 0% | 6 |
| K* | " | " | — | — | — | Undecahedron |

*Comparative sample

Each of Emulsions A to K was most suitably chemical-sensitized and then most suitably spectral-sensitized for the green spectral region according to the conditions shown in Table 2 below.

In Table 2, the amount of sensitizer is given in mg/mol-Ag.

TABLE 2

| | Chemical Sensitization | | | | | Spectral |
|---|---|---|---|---|---|---|
| Emulsion | Gold*1 | Sulfur*2 | Thiocyanate*3 | Ripening Time | Temperature | Sensitizing Dye A*4 |
| A | 3.5 | 10.0 | 200 | 30' | 70° C. | 400 |

TABLE 2-continued

| Emulsion | Chemical Sensitization Gold*1 | Sulfur*2 | Thiocyanate*3 | Ripening Time | Temperature | Spectral Sensitizing Dye A*4 |
|---|---|---|---|---|---|---|
| B | " | " | " | 30' | 70° C. | 400 |
| C | " | " | " | 30' | 70° C. | 400 |
| D | " | " | " | 30' | 70° C. | 400 |
| E | " | " | " | 30' | 70° C. | 400 |
| F | " | " | " | 30' | 70° C. | 450 |
| G | " | " | " | 30' | 70° C. | 350 |
| H | " | " | " | 30' | 70° C. | 700 |
| I | " | " | " | 30' | 70° C. | 370 |
| J | " | " | " | 30' | 70° C. | 500 |
| K | 3.0 | 5.0 | " | 30' | 70° C. | 500 |

*1Gold = Potassium Tetrachloraurate
*2Sulfur = Sodium Thiosulfate Pentahydrate
*3Thiocyanate = Thiocyanate
*4Dye A = Anhydro-5-chloro-9-ethyl-5'-phenyl-3'-(3-sulfobutyl)-3-(3-sulfopropyl)oxacarbocyaninehydroxy Sodium Salt Each of Emulsions A to K and a protective layer were coated on a triacetyl cellulose film support having a subbing layer by the manner shown below.

(1) Emulsion Layer:
Silver Halide Emulsion (Emulsions A to K shown in Table 1 above, 2.1 × $10^{-2}$ mol/m$^2$ as silver)
Coupler ($1.5 \times 10^{-3}$ mol/m$^2$)

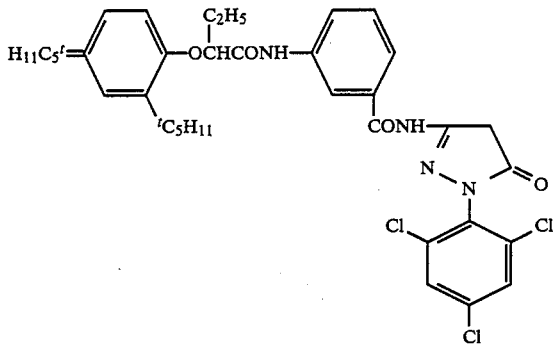

Tricresyl Phosphate (1.10 g/m$^2$)
Gelatin (2.30 g/m$^2$)

(2) Protective Layer:
2,4-Dichlorotriazine-6-hydroxy-s-triazine Sodium Salt (0.08 g/m$^2$)
Gelatin (1.80 g/m$^2$)

Each of the samples thus prepared was allowed to stand for 14 hours under the conditions of 40° C. and 70% relative humidity, subjected to sensitometric exposure and then subjected to the following color development processing.

The density of each sample thus processed was measured using a green filter.

The development processing was performed according to the following conditions at 38° C.

| | |
|---|---|
| 1. Color Development | 2 min. 45 sec. |
| 2. Bleach | 6 min. 30 sec. |
| 3. Wash | 3 min. 15 sec. |
| 4. Fix | 6 min. 30 sec. |
| 5. Wash | 3 min. 15 sec. |
| 6. Stabilization | 3 min. 15 sec. |

The compositions of the processing liquids used for the above steps were as follows.

| | |
|---|---|
| Color Developer | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methyl-aniline Sulfate | 4.5 g |
| Water to make | 1 liter |
| Bleach Solution | |
| Ammonium Bromide | 160.0 g |
| Aqueous Ammonia (28%) | 25.0 ml |
| Ethylenediamine-tetraacetic Acid Sodium Iron Salt | 130 g |
| Glacial Acetic Acid | 14 ml |
| Water to make | 1 liter |
| Fix Solution | |
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1 liter |
| Stabilization Solution | |
| Formalin | 8.0 ml |
| Water to make | 1 liter |

The green sensitivity was calculated as a relative value of the reciprocal of the exposure amount giving a density of fog+0.2 in lux-sec. with the value in the case of using Emulsion A being defined as 100.

Also, the graininess and sharpness of each sample were evaluated as follows.

The RMS granularity was obtained by uniformly exposing each sample at the exposure amount that gave a density of fog+0.2 and after applying the above-described development processing, measuring it according to the method described in *The Theory of the Photographic Process*, page 619, published by Macmillan, using a green filter.

The measurement of the sharpness was performed by measuring MTF. MTF was measured by the method described in *Journal of Applied Photographic Engineering*, Vol. 6 (1), 1-8 (1980). The development processing was performed by the method described hereinabove. The values of MTF are given as relative values compared to the case of defining the value of the sample having the layer of Emulsion A as 100.

The green sensitivity, RMS granularity, and MTF value of each sample are shown in Table 3.

TABLE 3

| Emulsion | Green-Sensitivity | RMS Granularity | MTF |
|---|---|---|---|
| A | 100 | 0.043 | 100 |
| B | 90 | 0.046 | 95 |
| C | 80 | 0.048 | 90 |
| D | 75 | 0.051 | 88 |
| E* | 65 | 0.053 | 83 |
| F | 85 | 0.048 | 80 |
| G | 75 | 0.049 | 78 |
| H | 83 | 0.050 | 97 |
| I | 75 | 0.052 | 94 |
| J* | 65 | 0.054 | 92 |
| K* | 50 | 0.054 | 80 |

*Comparative sample

As shown in Table 3 above, it can be seen that the emulsions of this invention are advantageous in the speed/granularity relationship as compared to conventional emulsions. Also, it is clear that as the ratio of grains having b/a≧5 or grains having b/a≧10 is increased, the speed/granularity relationship is improved.

Also, it can be seen that when the distribution of b/a is large, the distribution of the grain thickness becomes large, which results in reducing the sharpness.

EXAMPLE 2

Emulsion L

A silver halide emulsion described in Example 1 of Japanese Patent Publication No. 19496/85 was prepared and chemically sensitized under optimum conditions to provide Emulsion L.

Emulsion M (Step A): To an aqueous gelatin solution (composed of 1350 ml of water, 17 g of gelatin, and 3.7 g of potassium bromide) were simultaneously added 67.7 ml of an aqueous solution containing 0.90 mol/liter of silver nitrate and 67.7 ml of an aqueous solution containing 0.85 mol/liter of potassium bromide and 0.04 mol/liter of potassium iodide at a constant flow rate over a period of 45 seconds while maintaining the temperature of the solution at 45° C. and the resultant mixture was allowed to stand for 5 minutes. Then, the temperature was raised to 65° C. and after adding thereto 241 g of an aqueous 10% gelatin solution, the resultant mixture was allowed to stand for 30 minutes.

(Step B): Then, an aqueous solution containing 1.76 mol/liter of silver nitrate and an aqueous solution containing 2.72 mol/liter of potassium bromide and 0.236 mol/liter of potassium iodide were added thereto at constant flow rates while maintaining the pBr at 3.5 over a period of 30 minutes until the consumed amount of the aqueous solution of silver nitrate became 355 ml.

(Step C): Thereafter, an aqueous solution containing 1.76 mol/liter of silver nitrate and an aqueous solution containing 2.72 mol/liter of potassium bromide were added thereto at constant flow rates while maintaining the pBr at 3.5 over a period of 15 minutes until the consumed amount of the aqueous solution of silver nitrate became 300 ml.

(Step D): After completing precipitation, the silver halide emulsion obtained was cooled to 40° C. and after adding thereto 1.65 liters of an aqueous solution of 15.3% phthalated gelatin, the emulsion was washed twice by the coagulation method described in U.S. Pat. No. 2,614,929. Then, 0.55 liter of an aqueous solution of 10.5% bone gelatin was added to the emulsion and the pH and pBr of the emulsion were adjusted to 5.5 and 3.1, respectively at 40° C. to provide Emulsion M.

The silver halide grains formed were core/shell type tabular grains containing 4 mols of iodine, a mean grain diameter of 0.60 μm, and a mean aspect ratio of 3.

Emulsions N and O

In the preparation method for Emulsion M described above, by controlling the compositions of the aqueous halide solutions added in Step B and Step C, uniform AgI type silver halide grains and high surface AgI content type silver halide grains were prepared to provide Emulsions N and O, respectively.

The properties of Emulsions L to O thus obtained are shown in Table 4 below.

TABLE 4

| Emulsion | Iodine Content | Iodine Composition Structure | Mean Aspect Ratio | Mean Grain Diameter | Ratio of Grains of b/a ≧ 5 | Coefficient of Variation of Grain Thickness | Coefficient of Variation of Grain Diameter |
|---|---|---|---|---|---|---|---|
| L* | 4 | Inside-High AgI Type | 3 | 0.61μ | 30% | 50% | 40% |
| M | 4 | " | 3 | 0.60μ | 80% | 20% | 30% |
| N | 4 | Uniform AgI Type | 3 | 0.58μ | 80% | 20% | 30% |
| O | 4 | Surface-High AgI Type | 3 | 0.62μ | 80% | 20% | 30% |

*Comparative sample (an emulsion described in Japanese Patent Publication No. 19496/85)

Then, each of Emulsions L to O was chemically sensitized under optimum conditions and spectrally sensitized under optimum conditions for a green spectral region according to the conditions shown in Table 5 below, wherein the amounts of sensitizers are given in mg/mol-Ag.

TABLE 5

| Emulsion | Chemical Sensitization | | | | | Spectral Sensitizing Dye A |
|---|---|---|---|---|---|---|
| | Gold | Sulfur | Thiocyanate | Time | Temperature | |
| L | 0.6 | 7.0 | 100 | 30′ | 57° C. | 450 |
| M | 3.5 | 7.0 | 175 | 30′ | 70° C. | 450 |
| N | 3.5 | 7.0 | 175 | 30′ | 70° C. | 450 |
| O | 3.5 | 7.0 | 175 | 30′ | 70° C. | 450 |

As in the same manner as in Example 1, each of the emulsions was coated on a support to provide a sample and after exposing and processing each sample, the density was measured.

The green sensitivity was shown by a relative value of the reciprocal of the exposure amount giving a density of fog+0.2 in lux-sec. with the value of Emulsion L being defined as 100. The granularity and sharpness were evaluated by measuring the RMS granularity and MTF. The MTF value and RMS granularity were measured by the same methods as described in Example 1. MTF was given as a relative value with the value of Emulsion L being defined as 100. The gamma (γ) value was given as a relative value of the reciprocal of the difference between the exposure amount giving a sensitometric density of 1.0 and the exposure amount giving a sensitometric density of 0.5 with the value of Emulsion L being defined as 100.

The properties of the coated samples of the emulsions are shown in Table 6 below.

TABLE 6

| Emulsion | Sensitivity | RMS Granularity | MTF | Gamma Value |
|---|---|---|---|---|
| L* | 100 | 0.040 | 100 | 100 |
| M | 120 | 0.035 | 120 | 140 |
| N | 120 | 0.037 | 120 | 130 |
| O | 120 | 0.030 | 120 | 115 |

*Comparative sample

From the results shown in Table 6, it can be seen that the emulsions of this invention are better in speed and granularity than the emulsion described in Japanese Patent Publication No. 19496/85 in spite of having an iodine composition structure.

Also, by comparing Emulsions M, N and O of this invention, it can be seen that the emulsion having a high silver iodide content in the inside of the silver halide grains gives a higher gamma value. On the other hand, the emulsion having a high content of silver iodide in the surface portion of the grain gives good granularity although the gamma value thereof is low.

EXAMPLE 3

In this example, 18 types of emulsions shown in Table 7 below were prepared.

Emulsions 1, 2, 3 and 4 can be prepared according to the methods shown in the examples of Japanese Patent Application (OPI) No. 153428/77.

Emulsions 5, 6, 7 and 9 can be prepared according to the methods shown in the examples of Japanese Patent Application (OPI) No. 188639/84.

Emulsions 8 and 10 can be prepared according to the methods shown in the examples of Japanese Patent Application (OPI) No. 113926/83.

Also, Emulsions 11 to 18 of this invention were prepared by utilizing the fact that the iodine composition of the inside or the surface portion of silver halide grains can be desirably controlled by changing the iodine content in Step (B) and Step (C) in the preparation method for Emulsion M, the thickness of silver halide grains can be desirably controlled by changing the value of pAg in Step (B) and Step (C) in the preparation method for Emulsion M, and the grain diameter of silver halide grains can be desirably controlled by changing the temperature in Steps (A) to (C) in the preparation method for Emulsion M.

TABLE 7

| Emulsion | Iodine Content | Structure | Mean Grain Diameter | Coefficient of Variation of Grain Diameter | Mean Value of b/a | Rate of grains of b/a ≧ 5 | Mean Aspect Ratio |
|---|---|---|---|---|---|---|---|
| Em 1 | 4 | Uniform | 0.45μ | 30% | 3 | 30% | 3 |
| Em 2 | 6 | Inside AgI Type | 0.70μ | 172 | 3 | 20% | 3 |
| Em 3 | 2 | " | 0.78μ | 30% | 3 | 30% | 3 |
| Em 4 | 10 | " | 1.00μ | 30% | 3 | 30% | 3 |
| Em 5 | 4 | Uniform | 0.45μ | 10% | — | — | 1 |
| Em 6 | 6 | Inside AgI Type | 0.70μ | 10% | — | — | 1 |
| Em 7 | 2 | " | 0.78μ | 10% | — | — | 1 |
| Em 8 | 10 | " | 1.00μ | 30% | 7 | 40% | 11 |
| Em 9 | 10 | " | 1.00μ | 10% | — | — | 1 |
| Em 10 | 4 | Uniform | 0.45μ | 30% | 7 | 40% | 11 |
| Em 11* | 2 | Inside AgI Type | 0.78 μ | 20% | 10 | 80% | 3 |
| Em 12* | 6 | " | 0.70μ | 20% | 12 | 80% | 3 |
| Em 13* | 4 | Uniform | 0.45μ | 20% | 12 | 80% | 3 |
| Em 14* | 10 | Inside High AgI Type | 1.00μ | 30% | 7 | 60% | 7 |
| Em 15* | 4 | Uniform | 0.45μ | 30% | 7 | 60% | 7 |
| Em 16* | 2 | Inside High AgI Type | 0.78μ | 30% | 7 | 60% | 7 |
| Em 17* | 6 | " | 0.70μ | 35% | 7 | 60% | 7 |
| Em 18* | 4 | Uniform | 0.45μ | 35% | 7 | 60% | 7 |

*Sample of this invention

These emulsions were chemically sensitized under the optimum conditions as described in the above-described examples of the patent applications and by using the emulsions thus obtained, 21 kinds of samples (color photographic materials) having the multilayer structure as shown in Table 8 below were prepared.

In the following layer structure, the numeral showing the amount is a coated amount (coverage) shown by g/m² units, wherein, however, the numeral for the silver halide emulsion or colloidal silver is the coated amount calculated as silver and the numerals for sensitizing dyes and couplers are coated amounts to mol of silver halide in the same layer shown by mol unit.

| | |
|---|---|
| Layer 1 (Antihalation Layer): | |
| Black Colloidal Silver | 0.2 |
| Gelatin | 1.3 |
| ExM - 9 | 0.06 |
| UV - 1 | 0.03 |
| UV - 2 | 0.06 |
| UV - 3 | 0.06 |
| Solv - 1 | 0.15 |
| Solv - 2 | 0.15 |
| Solv - 3 | 0.05 |
| Layer 2 (Interlayer): | |
| Gelatin | 0.5 |
| Layer 3 (Low-Speed Red-Sensitive Emulsion Layer): | |
| Silver Iodobromide Emulsion | 1.8 |
| Gelatin | 1.0 |
| ExS - 1 | $4 \times 10^{-4}$ |
| ExS - 2 | $5 \times 10^{-4}$ |
| ExC - 1 | 0.05 |
| ExC - 2 | 0.50 |
| ExC - 3 | 0.03 |
| ExC - 4 | 0.12 |
| ExC - 5 | 0.01 |
| Layer 4 (High-Speed Red-Sensitive Emulsion Layer): | |

-continued

| | |
|---|---|
| Silver Iodobromide Emulsion | 0.7 |
| Gelatin | 1.0 |
| ExS - 1 | $3 \times 10^{-4}$ |
| ExS - 2 | $2.3 \times 10^{-5}$ |
| ExC - 6 | 0.11 |
| ExC - 7 | 0.05 |
| ExC - 4 | 0.05 |
| Solv - 1 | 0.05 |
| Solv - 3 | 0.05 |
| Layer 5 (Interlayer): | |
| Gelatin | 0.5 |
| Cpd - 1 | 0.1 |
| Solv - 1 | 0.05 |
| Layer 6 (Low-Speed Green-Sensitive Emulsion Layer): | |
| Silver Iodobromide Emulsion | 0.55 |
| Gelatin | 1.0 |
| ExS - 3 | $5 \times 10^{-4}$ |
| ExS - 4 | $3 \times 10^{-4}$ |
| ExS - 5 | $1 \times 10^{-4}$ |
| ExM - 8 | 0.4 |
| ExM - 9 | 0.07 |
| ExM - 10 | 0.02 |
| ExY - 11 | 0.03 |
| Solv - 1 | 0.3 |
| Solv - 4 | 0.05 |
| Layer 7 (High-Speed Green-Sensitive Emulsion Layer): | |
| Silver Iodobromide Emulsion | 0.8 |
| ExS - 3 | $5 \times 10^{-4}$ |
| ExS - 4 | $3 \times 10^{-4}$ |
| ExS - 5 | $1 \times 10^{-4}$ |
| ExM - 8 | 0.1 |
| ExM - 9 | 0.02 |
| ExY - 11 | 0.03 |
| ExC - 2 | 0.03 |
| ExM - 14 | 0.01 |
| Solv - 1 | 0.2 |
| Solv - 4 | 0.01 |
| Layer 8 (Interlayer): | |
| Gelatin | 0.5 |
| Cpd - 1 | 0.05 |
| Solv - 1 | 0.02 |
| Layer 9 (Doner Layer for Inter-layer Effect): | |
| Silver Iodobromide Emulsion | 0.55 |
| Gelatin | 0.5 |
| ExS - 3 | $8 \times 10^{-4}$ |
| ExY - 13 | 0.11 |
| ExM - 12 | 0.03 |
| ExM - 14 | 0.10 |
| Solv - 1 | 0.20 |
| Layer 10 (Yellow Filter Layer): | |
| Yellow Colloidal Silver | 0.05 |
| Gelatin | 0.5 |

-continued

| | |
|---|---|
| Cpd - 2 | 0.13 |
| Cpd - 7 | 0.10 |
| Layer 11 (Low-Speed Blue-Sensitive Emulsion Layer): | |
| Silver Iodobromide Emulsion | 0.45 |
| Gelatin | 1.6 |
| ExS - 6 | $2 \times 10^{-4}$ |
| ExC - 16 | 0.05 |
| ExC - 2 | 0.10 |
| ExC - 3 | 0.02 |
| ExY - 13 | 0.07 |
| ExY - 15 | 0.5 |
| ExY - 17 | 1.0 |
| Solv - 1 | 0.20 |
| Layer 12 (High-Speed Blue-Sensitive Emulsion Layer): | |
| Silver Iodobromide Emulsion | 0.5 |
| Gelatin | 0.5 |
| ExS - 6 | $1 \times 10^{-4}$ |
| ExY - 15 | 0.20 |
| ExY - 13 | 0.01 |
| Solv - 1 | 0.10 |
| Layer 13 (1st Protective Layer): | |
| Gelatin | 0.8 |
| UV - 4 | 0.1 |
| UV - 5 | 0.15 |
| Solv - 1 | 0.01 |
| Solv - 2 | 0.01 |
| Layer 14 (2nd Protective Layer): | |
| Fine Grain Silver Iodobromide Emulsion (silver iodide 2 mol%, mean grain diameter 0.07 μm, coefficient of variation of grain diameter 20%) | 0.5 |
| Gelatin | 0.45 |
| Polymethyl Methacrylate Particles (diameter: 1.5 μm) | 0.2 |
| H - 1 | 0.4 |
| Cpd - 3 | 0.5 |
| Cpd - 4 | 0.5 |

Each layer further contained Cpd-3 as a stabilizer and Cpd-4 (surface active agent) as a coating aid. Furthermore, Cpd-5 and Cpd-6 were added to each emulsion layer.

The compounds used for forming the above-described layer structure were as follows, in which the abbreviations are as follows. That is, "UV" is ultraviolet absorbent, "Solv" is solvent, "Cpd" is compound, "ExC" is cyan coupler, "ExM" is magenta coupler, "ExY" is yellow coupler, "ExS" is sensitizing dye, and "H" is hardener.

UV-1

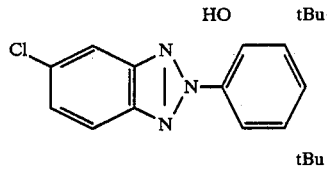

UV-2

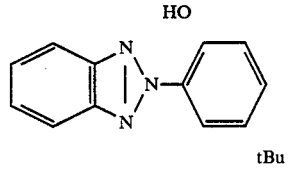

-continued
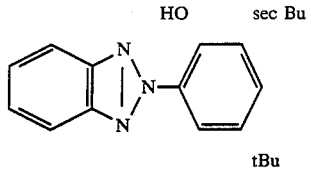
UV-3
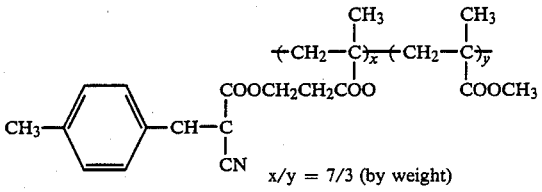
UV-4
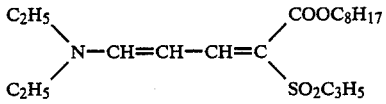
UV-5
Tricresyl Phosphate Solv-1
Dibutyl Phthalate Solv-2
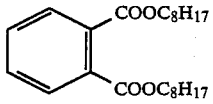
Solv-3
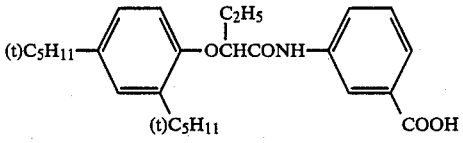
Solv-4
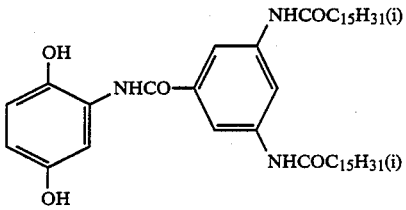
Cpd-1
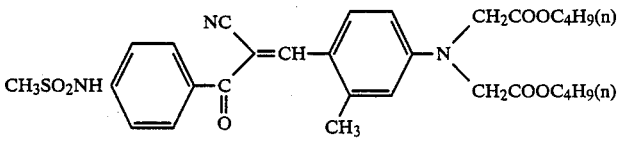
Cpd-2
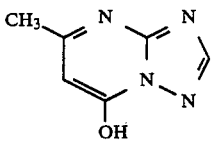
Cpd-3
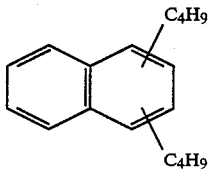
Cpd-4

-continued
Cpd-5
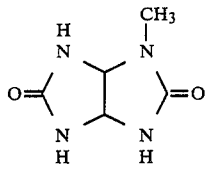
Cpd-6
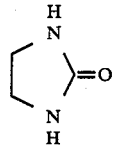
Cpd-7
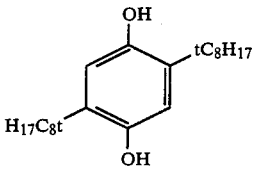
ExC-1
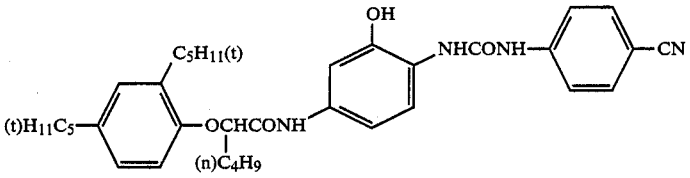
ExC-2
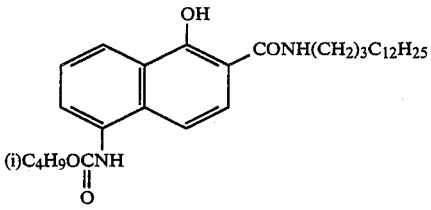
ExC-3
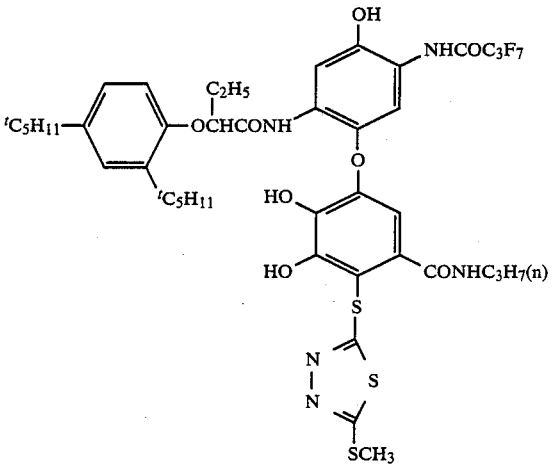
ExC-4
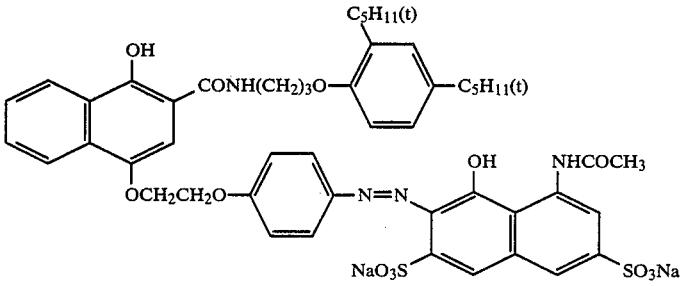

-continued
ExC-5
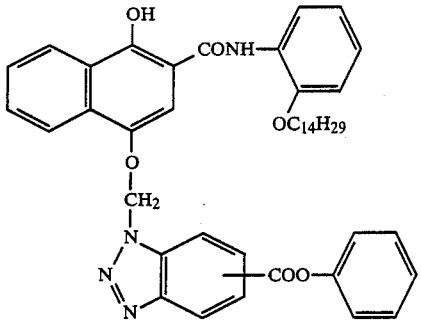
ExC-6
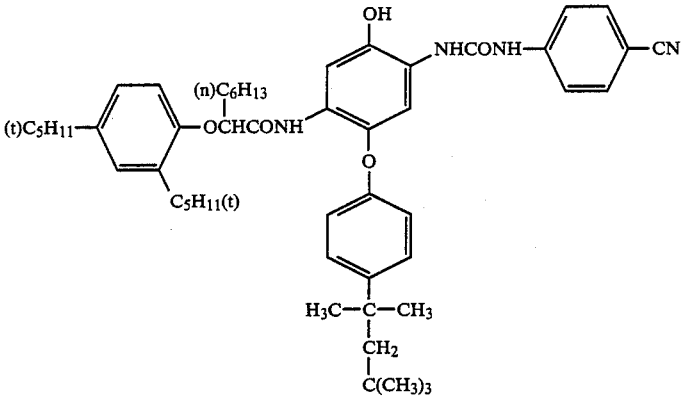
ExC-7
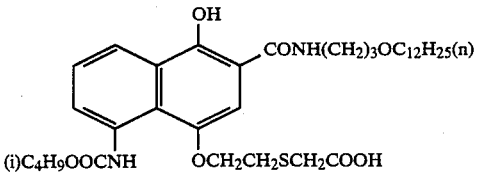
ExM-8
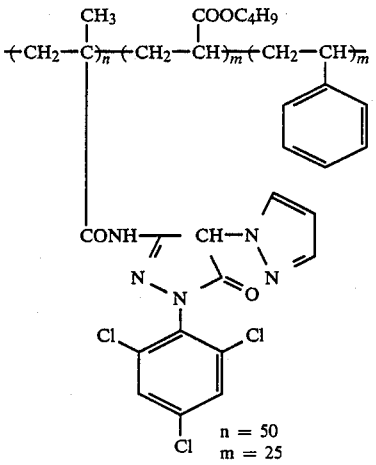

-continued
ExM-9
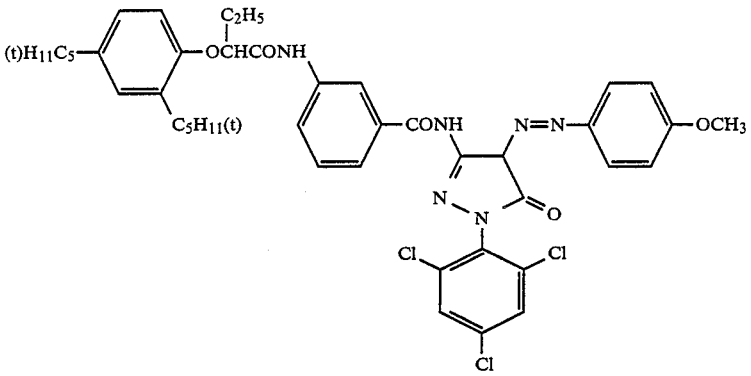
ExM-10
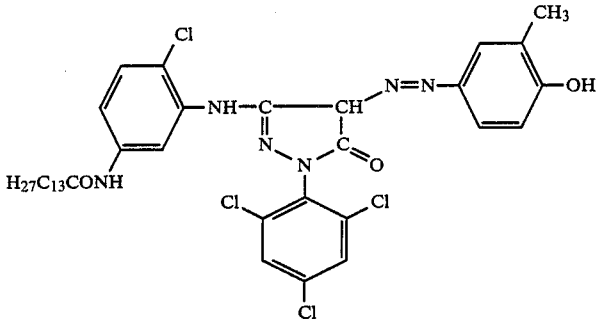
ExY-11
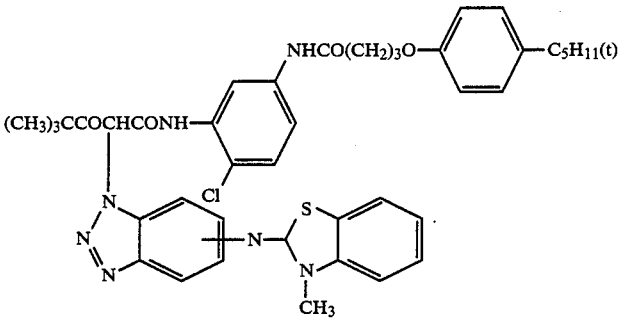
ExM-12
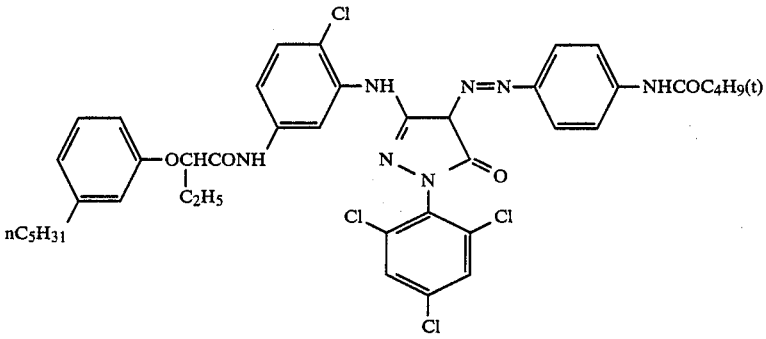
ExY-13
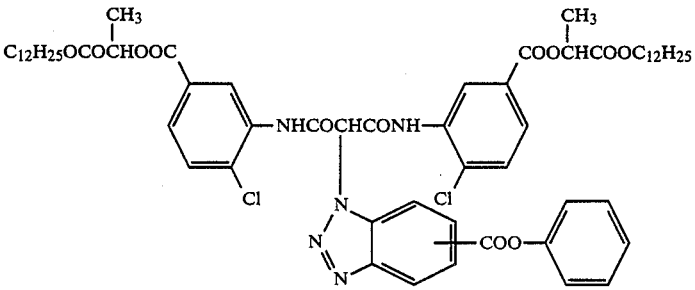

-continued
ExM-14
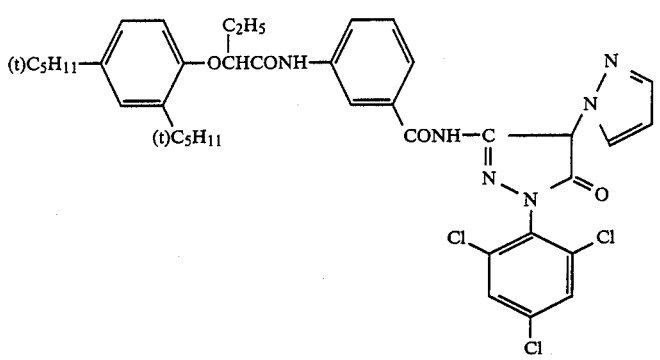
ExY-15
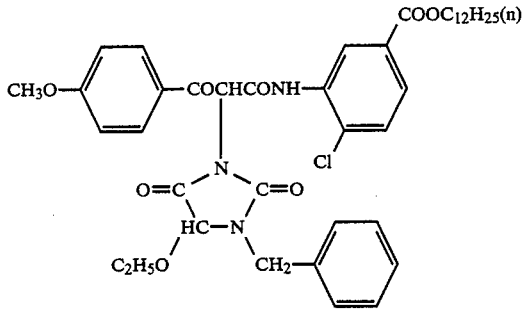
ExC-16
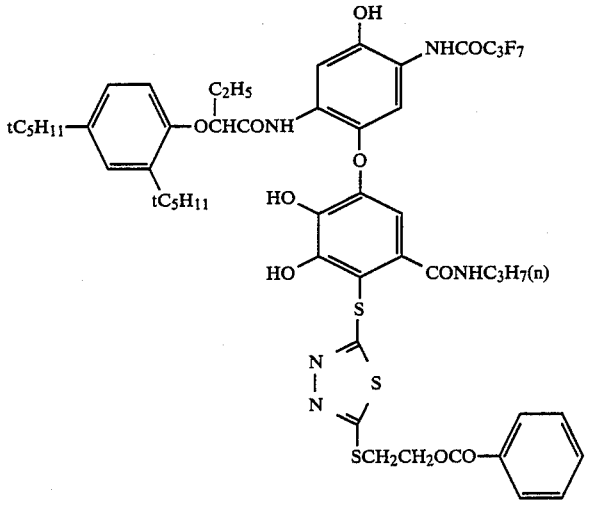
ExY-17
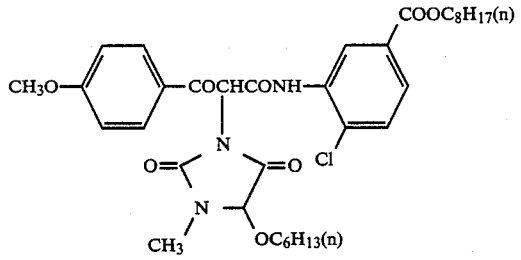
ExS-1
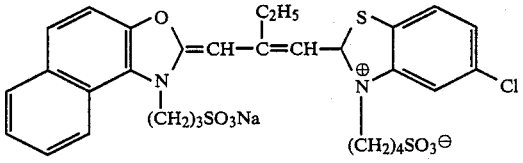

-continued

ExS-2

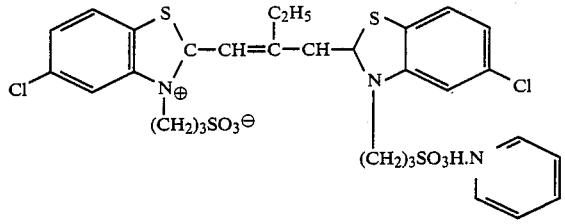

ExS-3

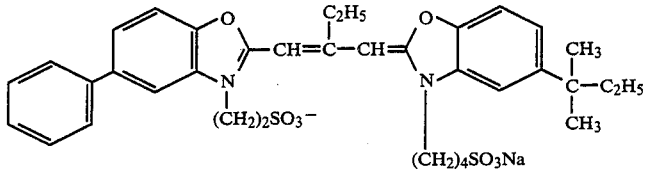

ExS-4

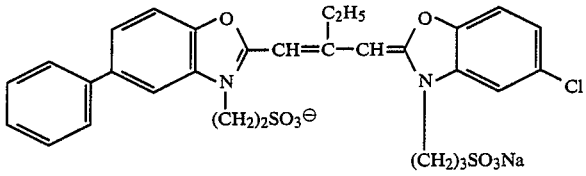

ExS-5

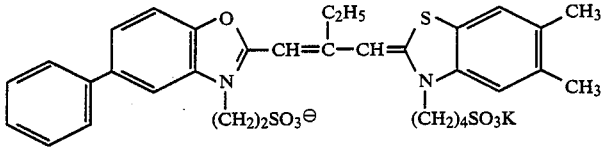

ExS-6

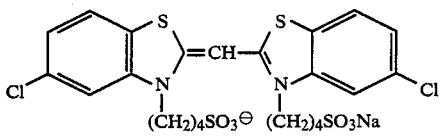

H-1

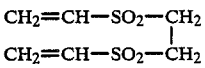

TABLE 8

| Sample No. | Layer 3 | Layer 4 | Layer 6 | Layer 7 | Layer 9 | Layer 11 | Layer 12 |
|---|---|---|---|---|---|---|---|
| 1* | Em 1 | Em 2 | Em 1 | Em 2 | Em 3 | Em 1 | Em 4 |
| 2* | Em 5 | Em 6 | Em 5 | Em 6 | Em 7 | " | " |
| 3 | " | " | " | " | Em 11 | " | " |
| 4 | " | Em 12 | " | Em 12 | " | " | " |
| 5 | Em 13 | Em 6 | Em 13 | Em 6 | " | " | " |
| 6 | " | Em 12 | " | Em 12 | " | " | " |
| 7* | Em 5 | Em 6 | Em 5 | Em 6 | Em 7 | Em 10 | Em 8 |
| 8 | " | " | " | " | Em 11 | " | " |
| 9 | " | Em 12 | " | Em 12 | " | " | " |
| 10 | Em 13 | Em 6 | Em 13 | Em 6 | " | " | " |
| 11 | " | Em 12 | " | Em 12 | " | " | " |
| 12 | Em 5 | Em 6 | Em 5 | Em 6 | Em 7 | Em 15 | Em 14 |
| 13 | " | " | " | " | Em 11 | " | " |
| 14 | " | Em 12 | " | Em 12 | " | " | " |
| 15 | Em 13 | Em 6 | Em 13 | Em 6 | " | " | " |
| 16 | " | Em 12 | " | Em 12 | " | " | " |
| 17 | " | " | " | " | " | " | Em 9 |
| 18 | " | " | " | " | Em 16 | " | Em 14 |
| 19 | " | Em 17 | " | Em 17 | " | " | " |
| 20 | Em 18 | Em 12 | Em 18 | Em 12 | " | " | " |
| 21 | " | Em 17 | " | Em 17 | " | " | " |

*Comparative sample

When Samples 1 to 21 thus obtained were suitably exposed to white light and processed as in Example 1, speeds and gradations similar to each other could be obtained.

The granularity of each sample thus processed was evaluated using the RMS granularity. The RMS value was obtained by uniformly exposing each sample at the exposure amount of white light necessary for obtaining a density of fog+0.2 in the case of measuring the density, processing the sample by the same manner as described in Example 1, and then measuring using red, green, and blue filters by the method described in The *Theory of the Photographic Process*, 4th edition, page 619, published by Macmillan.

The sharpness thereof was evaluated by measuring MTF. The measurement of MTF was performed by the method described in *Journal of Applied Physics Engineering*, Vol. (1), 1–8 (1980). The development proccessing was performed by the process described in Example 1 described above. The value of MTF is shown by a relative value with the MTF value of Sample 1 measured using a blue filter being defined as 100.

The RMS granularities and MTF values of the samples thus obtained are shown in Table 9 below.

TABLE 9

| Sample No. | RMS Granularity R | G | B | Sharpness (MTF Value) R | G | B |
|---|---|---|---|---|---|---|
| 1* | 0.033 | 0.030 | 0.040 | 100 | 110 | 110 |
| 2* | 0.031 | 0.028 | 0.040 | 105 | 114 | 113 |
| 3 | 0.031 | 0.028 | 0.039 | 105 | 114 | 113 |
| 4 | 0.030 | 0.027 | 0.039 | 107 | 116 | 115 |
| 5 | 0.030 | 0.027 | 0.039 | 107 | 116 | 115 |
| 6 | 0.029 | 0.026 | 0.039 | 108 | 117 | 116 |
| 7* | 0.031 | 0.028 | 0.042 | 107 | 116 | 114 |
| 8 | 0.030 | 0.028 | 0.041 | 107 | 116 | 114 |
| 9 | 0.030 | 0.027 | 0.042 | 108 | 118 | 116 |
| 10 | 0.030 | 0.027 | 0.041 | 109 | 117 | 115 |
| 11 | 0.029 | 0.026 | 0.042 | 110 | 119 | 117 |
| 12 | 0.031 | 0.028 | 0.040 | 107 | 116 | 114 |
| 13 | 0.030 | 0.028 | 0.039 | 106 | 115 | 114 |
| 14 | 0.030 | 0.027 | 0.039 | 108 | 117 | 116 |
| 15 | 0.030 | 0.027 | 0.039 | 109 | 117 | 115 |
| 16 | 0.029 | 0.026 | 0.039 | 109 | 119 | 117 |
| 17 | 0.029 | 0.026 | 0.040 | 111 | 121 | 118 |
| 18 | 0.029 | 0.026 | 0.040 | 108 | 118 | 116 |
| 19 | 0.030 | 0.027 | 0.040 | 107 | 117 | 114 |
| 20 | 0.030 | 0.027 | 0.040 | 106 | 116 | 114 |
| 21 | 0.031 | 0.028 | 0.040 | 105 | 115 | 113 |

*Comparative Sample

By comparing the results for Samples 2 to 6 shown in Table 9 above, it can be seen that the granularity and sharpness are improved by replacing a part or all of the green-sensitive emulsion layer and red-sensitive emulsion layer with the silver halide emulsion of this invention.

Also, by comparing the results of Samples 7 to 11 with each other and comparing the results of Samples 12 to 16 with each other, the same matters as the case of comparing the results of Samples 2 to 6 described above are shown.

Also, by the comparison of the results of Samples 2, 7 and 12 with each other, the comparison of the results of Samples 3, 8 and 13 with each other, the comparison of the results of Samples 5, 10 and 15 and the comparison of the results of Samples 6, 11 and 16, it can be seen that the granularity and sharpness become better in the case of using the silver halide emulsions of this invention having aspect ratios of from 5 to 8 for the blue-sensitive emulsion layer.

Furthermore, by comparison of the results of Samples 16 and 17 with each other, it can be seen that the granularity and sharpness are more improved by using the monodisperse normal crystal grain emulsion for the high-speed blue-sensitive emulsion layer only.

Also, by the comparisons of the results of Samples 16 and 18 to 21 with each other, it can be seen that the granularity and sharpness are more improved in the case of using the silver halide emulsion of this invention containing tabular grain silver halide having an aspect ratio of not more than 5 for the green-sensitive emulsion layer and the red-sensitive emulsion layer than the case of using the silver halide emulsion of this invention containing tabular grain silver halide having an aspect ratio of from 5 to 8.

Sample 7 is the embodiment described in Japanese Patent Application No. 235763/86. It can be seen that by using the silver halide emulsion of this invention for the green-sensitive emulsion layer and the red-sensitive emulsion layer in place of a normal crystal silver halide emulsion, the granularity and sharpness can be more improved.

EXAMPLE 4

In the multilayer color photographic materials shown in Example 3 described above, by replacing ExM-8 in Layer 6 and Layer 7 with 1.3 mol times of ExM-18 and using Em-1 to Em-18, samples corresponding to Samples 1 to 21 shown in Table 8 described above were prepared.

Also, in the multilayer color photographic materials in Example 3, by replacing ExY-15 in Layer 11 and Layer 12 with 1.2 mol times of ExY-19 shown below, samples corresponding to Samples 1 to 21 were prepared.

Each of the samples was processed as in Example 3 and the granularity and the sharpness were evaluated. The results obtained were almost same as those shown in Table 9 above.

ExM-18

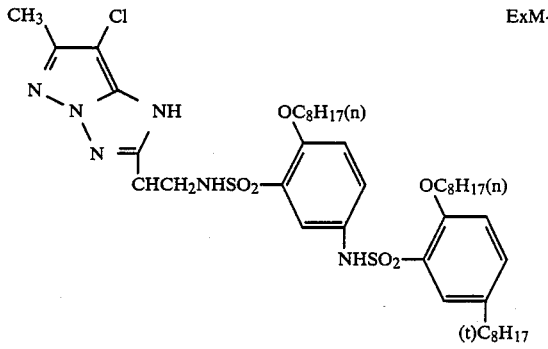

ExY-19

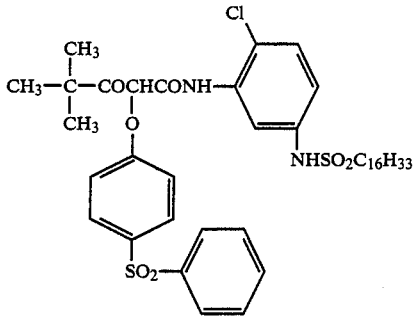

EXAMPLE 5

A multilayer color photographic material (Sample 22) was prepared by forming the layers having the following compositions on a triacetyl cellulose film support having a subbing layer.

In the following layer structure, the numeral for each component is the coated amount shown by a g/m$^2$ unit. However, the numeral for silver halide emulsion and colloidal silver is the coated amount calculated as silver and the numeral for sensitizing dye and coupler is the coated amount for mol of silver halide in the same layer shown by mol unit.

| | |
|---|---|
| Layer 1 (Antihalation Layer): | |
| Black Collidal Silver | 0.2 |
| Gelatin | 2.6 |
| Cpd - 10 | 0.2 |
| Solv - 5 | 0.02 |
| Layer 2 (Interlayer): | |
| Fine Grain Silver Bromide (mean grain diameter: 0.07 μm) | 0.15 |
| Gelatin | 1.0 |

-continued

| | |
|---|---|
| Layer 3 | |
| (Low-Speed Red-Sensitive Emulsion Layer): | |
| Monodisperse Normal Crystal Silver Iodobromide Emulsion (silver iodide 5.5 mols, mean grain diameter 0.3 μm, coefficient of variation of grain diameter (hereinafter, variation coeff.) 19%) | 1.5 |
| Gelatin | 3.0 |
| ExS - 7 | $2.0 \times 10^{-4}$ |
| ExS - 8 | $1.0 \times 10^{-4}$ |
| ExS - 9 | $0.3 \times 10^{-4}$ |
| ExC - 20 | 0.7 |
| ExC - 21 | 0.1 |
| ExC - 22 | 0.02 |
| Cpd - 8 | 0.01 |
| Solv - 5 | 0.8 |
| Solv - 6 | 0.2 |
| Solv - 8 | 0.1 |
| Layer 4 | |
| (High-Speed Red-Sensitive Emulsion Layer): | |
| Monodisperse Normal Crystal Silver Iodobromide Emulsion (silver iodide 3.5 mol %, mean grain diameter 0.7 μm, variation coeff. 18%) | 1.2 |
| Gelatin | 2.5 |
| ExS - 7 | $3 \times 10^{-4}$ |
| ExS - 8 | $1.5 \times 10^{-4}$ |
| ExS - 9 | $0.45 \times 10^{-4}$ |
| ExC - 23 | 0.15 |
| ExC - 24 | 0.05 |
| ExC - 21 | 0.03 |
| ExC - 22 | 0.01 |
| Solv - 5 | 0.05 |
| Solv - 6 | 0.3 |
| Layer 5 (Interlayer): | |
| Gelatin | 0.8 |
| Cpd - 9 | 0.05 |
| Solv - 7 | 0.01 |
| Layer 6 | |
| (Low-Speed Green-Sensitive Emulsion Layer): | |
| Monodisperse Normal Crystal Silver Iodobromide Emulsion (silver iodide: 5 mol %, mean grain diameter 0.3 μm, variation coeff. 19%) | 0.4 |
| Monodisperse Normal Crystal Silver Iodobromide Emulsion (silver iodide 7 mol %, mean grain diameter 0.5 μm) | 0.8 |
| Gelatin | 3.0 |
| ExS - 10 | $1 \times 10^{-4}$ |
| ExS - 11 | $4 \times 10^{-4}$ |
| ExS - 12 | $1 \times 10^{-4}$ |
| ExM - 25 | 0.2 |
| ExM - 26 | 0.4 |
| ExM - 27 | 0.16 |
| ExC - 28 | 0.05 |
| Solv - 6 | 1.2 |
| Solv - 8 | 0.05 |
| Solv - 9 | 0.01 |
| Layer 7 | |
| (High-Speed Green-Sensitive Emulsion Layer): | |
| Monodisperse Normal Crystal Silver Iodobromide Emulsion (silver iodide 3.5 mol %, mean grain diameter 0.8 μm, variation coeff. 15%) | 0.9 |
| Gelatin | 1.6 |

-continued

| | |
|---|---|
| ExS - 10 | $0.7 \times 10^{-4}$ |
| ExS - 11 | $2.8 \times 10^{-4}$ |
| ExS - 12 | $0.7 \times 10^{-4}$ |
| ExM - 26 | 0.05 |
| ExM - 27 | 0.04 |
| ExC - 28 | 0.01 |
| Solv - 5 | 0.08 |
| Solv - 6 | 0.3 |
| Solv - 8 | 0.03 |
| Layer 8 (Yellow Filter Layer): | |
| Yellow Colloidal Silver | 0.2 |
| Gelatin | 0.9 |
| Cpd - 9 | 0.2 |
| Solv - 6 | 0.1 |
| Layer 9 | |
| (Low-Speed Blue-Sensitive Emulsion Layer): | |
| Monodisperse Normal Crystal Silver Iodobromide Emulsion (silver iodide 6 mol %, mean grain diameter 0.3 μm, variation coeff. 20%) | 0.4 |
| Monodisperse Normal Crystal Silver Iodobromide Emulsion (silver iodide 5 mol %, mean grain diameter 0.6 μm, variation coeff. 17%) | 0.4 |
| Gelatin | 2.9 |
| ExS - 13 | $1 \times 10^{-4}$ |
| ExS - 14 | $1 \times 10^{-4}$ |
| ExY - 29 | 1.2 |
| ExC - 22 | 0.05 |
| Solv - 6 | 0.4 |
| Solv - 8 | 0.1 |
| Layer 10 | |
| (High-Speed Blue-Sensitive Emulsion Layer): | |
| Monodisperse Normal Crystal Silver Iodobromide Emulsion (silver iodide 6 mol %, mean grain diameter 1.5 μm, variation coeff. 14%) | 0.5 |
| Gelatin | 2.2 |
| ExS - 13 | $5 \times 10^{-5}$ |
| ExS - 14 | $5 \times 10^{-5}$ |
| ExY - 29 | 0.4 |
| ExC - 22 | 0.02 |
| Solv - 6 | 0.1 |
| Layer 11 (lst Protective Layer): | |
| Gelatin | 1.0 |
| Cpd - 10 | 0.1 |
| Cpd - 11 | 0.1 |
| Cpd - 12 | 0.1 |
| Cpd - 13 | 0.1 |
| Solv - 5 | 0.1 |
| Solv - 8 | 0.1 |
| Layer 12 (2nd Protective Layer): | |
| Fine Grain Silver Bromide Emulsion (mean grain size 0.07 μm) | 0.25 |
| Gelatin | 1.0 |
| Polymethyl Methacrylate Particles (diameter 1.5 μm) | 0.2 |
| Cpd - 15 | 0.5 |

Furthermore, each layer further contained surface active agent, Cpd-14 and hardening agent H-1.

The abbreviations in the above layer structure are the same as those in Example 3.

The compounds used for the above layer structure were as follows.

ExS-7

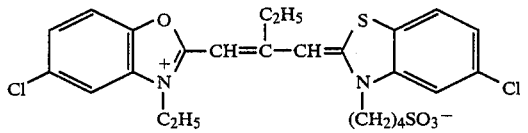

-continued
ExS-8
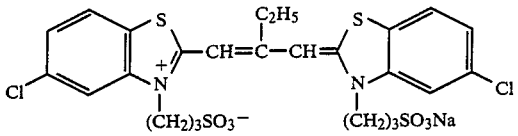
ExS-9
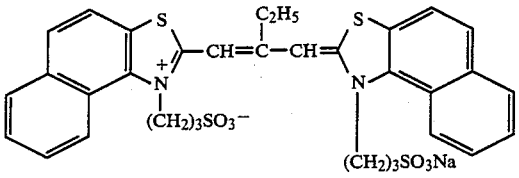
ExS-10
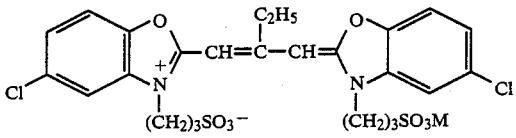
ExS-11
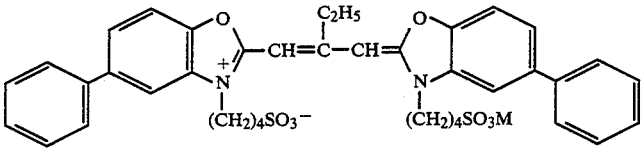
ExS-12
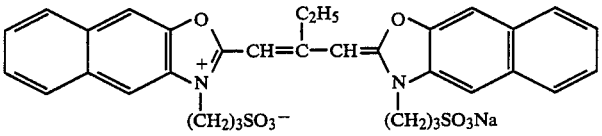
ExS-13
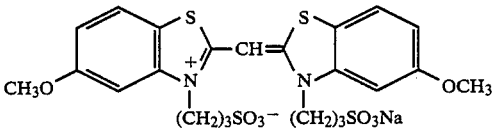
ExS-14
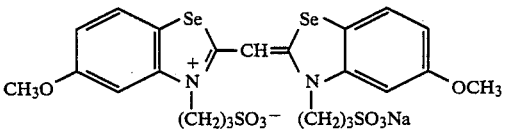
ExC-20
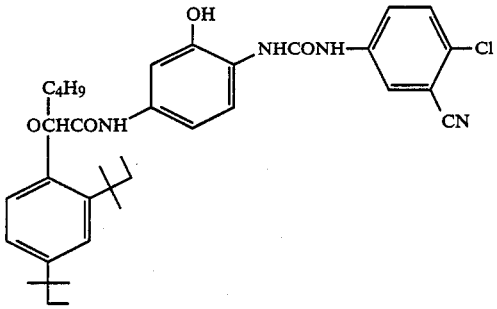

-continued
ExC-21
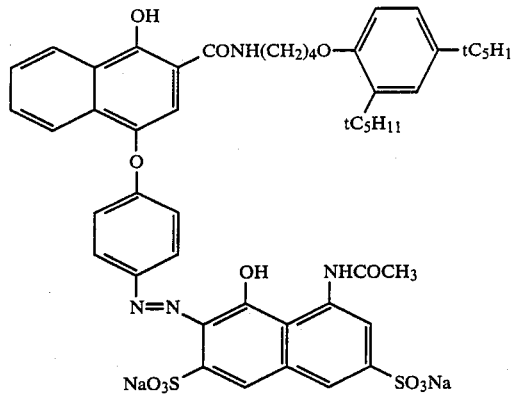
ExC-22
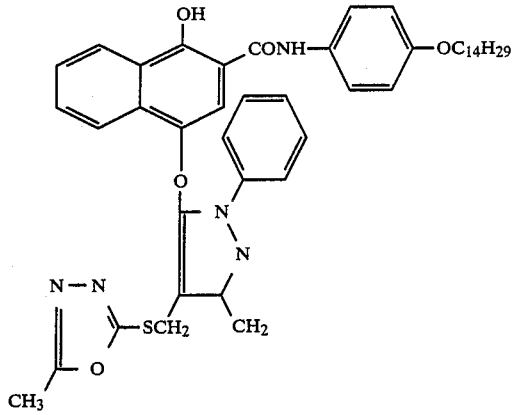
ExC-23
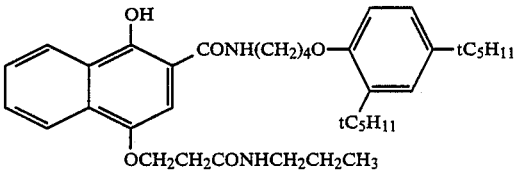
ExC-24
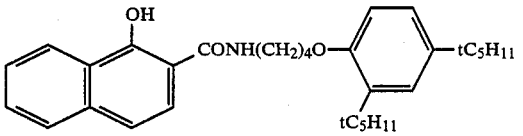
ExM-25
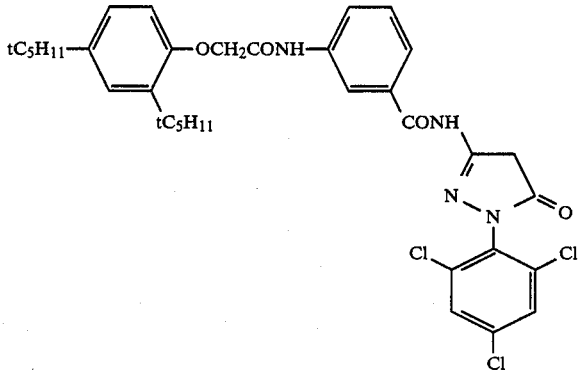

-continued
ExM-26
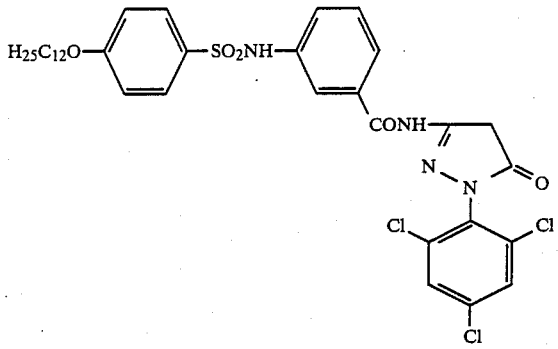
ExM-27
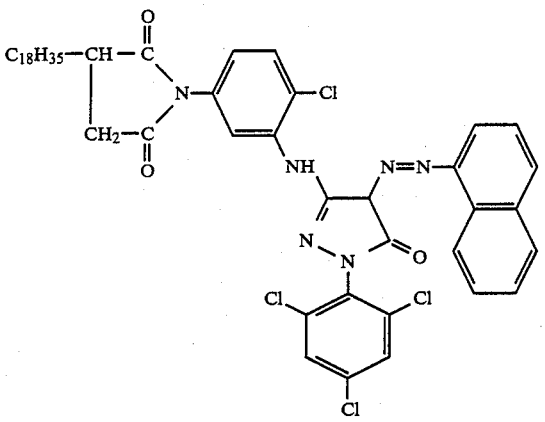
ExC-28
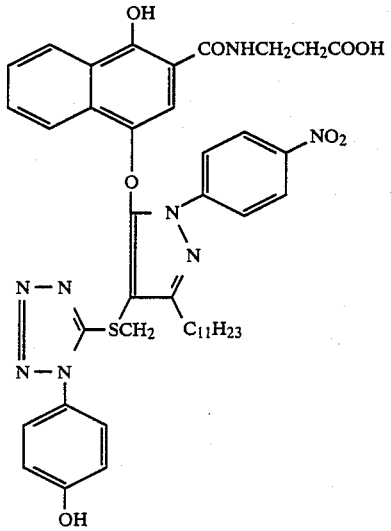
ExY-29
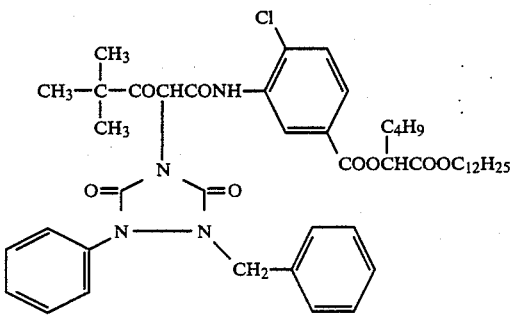

-continued
Cpd-8
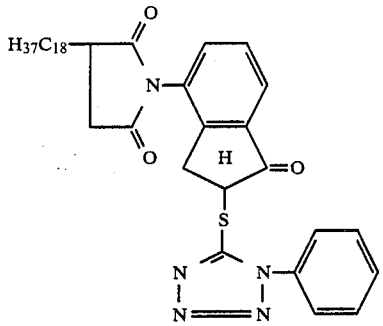
Cpd-9
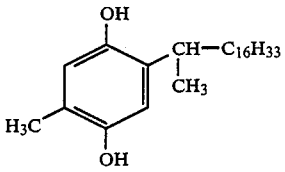
Cpd-10
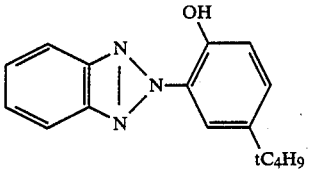
Cpd-11
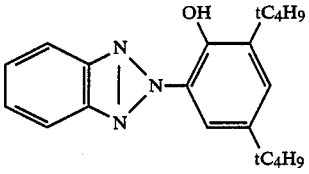
Cpd-12
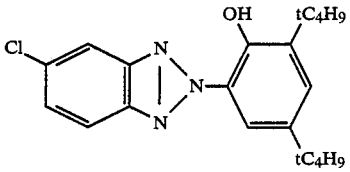
Cpd-13
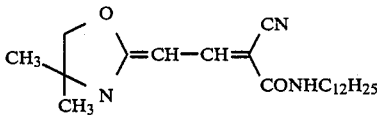
Cpd-14
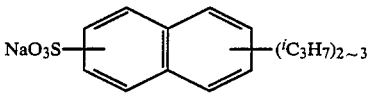
Cpd-15
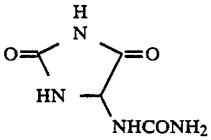
Solv-5
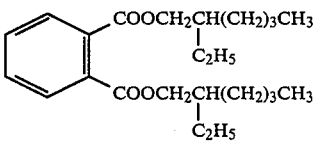

-continued

Solv-6

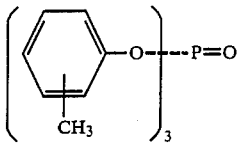

Solv-7

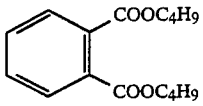

Solv-8

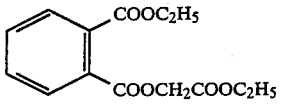

Solv-9

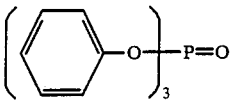

The sample thus prepared was subjected to image-wise exposure of maximum 10 CMS using an argon light source adjusted to 4,800° K. with a color temperature conversion filter, color-developed as in Example 1 at 38° C., and then the photographic performance was evaluated.

Also, Sample 23 was prepared by changing the following points in the procedure of preparing Sample 22.

(1) The silver halide emulsion in Layer 3 was changed to EM 13 of this invention as used in Example 3.

(2) The silver halide emulsions in Layer 6 were all changed to Em 13 of this invention.

Sample 24 was prepared by changing the following points in the case of Sample 23.

(1) The silver halide emulsion in Layer 4 was changed into Em 11 of this invention.

(2) The silver halide emulsion in Layer 7 was changed into Em 11 of this invention.

Sample 25 was prepared by changing the following point in the case of Sample 22.

(1) The silver halide emulsions in Layer 9 were all changed to Em 15 of this invention.

Sample 26 was prepared by changing the following point in the case of Sample 25.

(1) The silver halide emulsion in Layer 10 was changed to Em 14 of this invention.

Samples 27 and 28 were prepared by changing the following point in the cases of Samples 23 and 24, respectively.

(1) The silver halide emulsions in Layer 9 were all changed to Em 15 of this invention.

Sample 29 was prepared by changing the following point in the case of Sample 28.

(1) The silver halide emulsion in Layer 3 was changed to Em 13 of this invention.

(2) The silver halide emulsion in Layer 4 was changed to Em 11 of this invention.

(3) The silver halide emulsions in Layer 6 were all changed to Em 13 of this invention.

(4) The silver halide emulsion in Layer 7 was changed to Em 11 of this invention.

Sample 30 was prepared by changing the following point in the case of Sample 29.

(1) The silver halide emulsions in Layer 9 were all changed to Em 15 of this invention.

Samples 22 to 30 thus prepared were exposed, developed, and the granularity and the sharpness of each sample were measured as in Example 3. The results obtained are shown in Table 10 below.

TABLE 10

| Sample | RMS Granularity | | | Sharpness | | |
|---|---|---|---|---|---|---|
| No. | R | G | B | R | G | B |
| 22* | 0.030 | 0.031 | 0.033 | 100 | 102 | 104 |
| 23 | 0.029 | 0.029 | 0.033 | 102 | 103 | 105 |
| 24 | 0.027 | 0.028 | 0.033 | 104 | 105 | 106 |
| 25 | 0.030 | 0.031 | 0.030 | 105 | 106 | 106 |
| 26 | 0.030 | 0.031 | 0.030 | 105 | 106 | 106 |
| 27 | 0.029 | 0.029 | 0.030 | 106 | 107 | 108 |
| 28 | 0.028 | 0.028 | 0.029 | 107 | 108 | 109 |
| 29 | 0.029 | 0.030 | 0.032 | 100 | 101 | 103 |
| 30 | 0.029 | 0.030 | 0.033 | 101 | 102 | 104 |

*Comparative sample

From the results shown in Table 10, it can be seen that by using the silver halide emulsion of this invention for the green-sensitive emulsion layer and the red-sensitive emulsion layer in Sample 22 (comparative sample), the granularity and sharpness are improved.

EXAMPLE 6

When the following compounds, Cpd-16 to Cpd-29 were properly used for Layer 1 to Layer 12 of each of Samples 1 to 21 in Example 3, almost the same effects as shown in Table 9 above were obtained.

Also, when the following compounds, Cpd-16 to Cpd-29 were properly used for Layer 1 to Layer 12 of each of Samples 22 to 30 in Example 5, amost the same effect as shown in Table 10 above were obtained.

Cpd-16

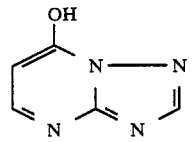

-continued

Cpd-17

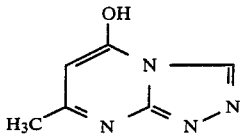

Cpd-18

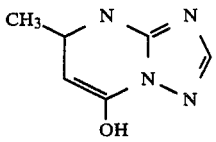

Cpd-19

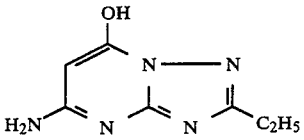

Cpd-20

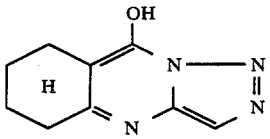

Cpd-21

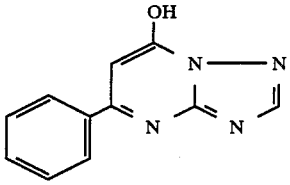

Cpd-22

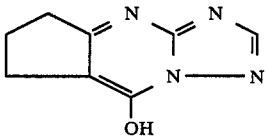

Cpd-23

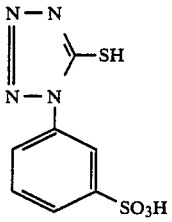

Cpd-24

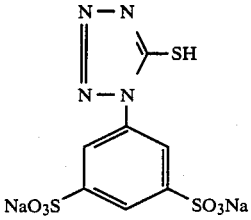

-continued

Cpd-25

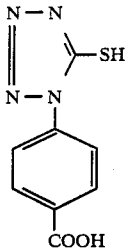

Cpd-26

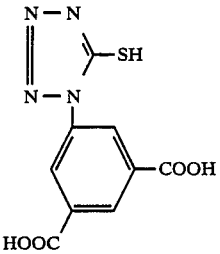

Cpd-27

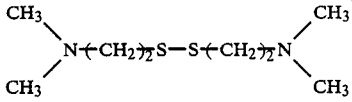

Cpd-28

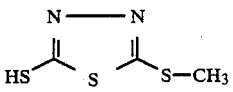

Cpd-29

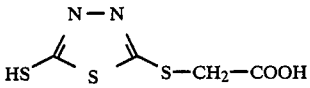

As described in Examples 1 to 6, the silver halide emulsions of this invention are excellent in speed/granularity relationship and sharpness and by using the silver halide emulsions, multilayer color photographic materials excellent in speed/granularity relationship and sharpness can be obtained.

While the invention has been described in detail and with reference to specific embodiments thereof, it will be apparent to one skilled in the art that various changes and modifications can be made therein without departing from the spirit and scope thereof.

What is claimed is:

1. A light-sensitive silver halide emulsion comprising light-sensitive silver halide grains in a binder, wherein tabular grains having a diameter of at least 0.15 μm account for at least 70% of the total projected area of said silver halide grains, said tabular grains have a mean aspect ratio of not more than 8.0, and at least 50% (by number) of all of said tabular grains are tabular grains in which the ratio (b/a) of the thickness (b) of said tabular grain to the longest spacing (a) between two or more parallel twinning planes of said tabular grain is at least 5.

2. A color photographic material comprising a support having thereon at least one blue-sensitive silver halide emulsion layer, at least one green-sensitive silver halide emulsion layer, and at least one red-sensitive silver halide emulsion layer, wherein at least one of the silver halide emulsion layers other than the silver halide emulsion layer disposed at the farthest position from the support comprises a light-sensitive silver halide emulsion, wherein tabular grains having a diameter of at least 0.15 μm account for at least 70% of the total projected area of all silver halide grains in said one of the silver halide emulsion layers, said tabular grains have a mean aspect ratio of not more than 8.0, and at least 50% (by number) of all of said tabular grains are tabular grains in which the ratio (b/a) of the thickness (b) of said tabular grain to the longest spacing (a) between two or more parallel twinning planes of said tabular grain is at least 5.

3. The light-sensitive silver halide emulsion as claimed in claim 1, wherein at least 70% (by number) of all of said tabular grains are tabular grains in which b/a is 5 or more.

4. The light-sensitive silver halide emulsion as claimed in claim 1, wherein at least 90% (by number) of all of said tabular grains are tabular grains in which b/a is 5 or more.

5. The light-sensitive silver halide emulsion as claimed in claim 1, wherein at least 50% (by number) of all of said tabular grains are tabular grains in which b/a is at least 10.

6. The light-sensitive silver halide emulsion as claimed in claim 1, wherein at least 70% (by number) of all of said tabular grains are tabular grains in which b/a is at least 10.

7. The light-sensitive silver halide emulsion as claimed in claim 1, wherein at least 90% (by number) of all of said tabular grains are tabular grains in which b/a is at least 10.

8. The light-sensitive silver halide emulsion as claimed in claim 1, wherein said tabular grains having a diameter of at least 0.15 μm have a mean aspect ratio of not more than 5.0.

9. The light-sensitive silver halide emulsion as claimed in claim 1, wherein coefficient of variation of the thickness (b) of said tabular grains having a diameter of at least 0.15 μm is not more than 20%.

10. The light-sensitive silver halide emulsion as claimed in claim 1, werein coefficient of variation of the b/a of said tabular grains having a diameter of at least 0.15 μm is not more than 20%.

11. The light-sensitive silver halide emulsion as claimed in claim 1, wherein coefficient of variation of the grain diameter of said tabular grains having a diameter of at least 0.15 μm is not more than 30%.

12. The light-sensitive silver halide emulsion as claimed in claim 1, wherein said light-sensitive silver halide grains are silver iodobromide having a silver iodide content of from 0.1 to 20 mol%.

13. The silver halide color photographic material as claimed in claim 2, wherein at least 70% (by number) of all of said tabular grains are tabular grains in which b/a is 5 or more.

14. The silver halide color photographic material as claimed in claim 2, wherein at least 90% (by number) of all of said tabular grains are tabular grains in which b/a is 5 or more.

15. The silver halide color photographic material as claimed in claim 2, wherein at least 50% (by number) of all of said tabular grains are tabular grains in which b/a is at least 10.

16. The silver halide color photographic material as claimed in claim 2, wherein at least 70% (by number) of all of said tabular grains are tabular grains in which b/a is at least 10.

17. The silver halide color photographic material as claimed in claim 2, wherein at least 90% (by number) of all of said tabular grains are tabular grains in which b/a is at least 10.

18. The silver halide color photographic material as claimed in claim 2, wherein said tabular grains having a diameter of at least 0.15 μm have a mean aspect ratio of not more than 5.0.

19. The silver halide color photographic material as claimed in claim 2, wherein coefficient of variation of the thickness (b) of said tabular grains having a diameter of at least 0.15 μm is not more than 20%.

20. The silver halide color photographic material as claimed in claim 2, wherein coefficient of variation of the b/a of said tabular grains having a diameter of at least 0.15 μm is not more than 20%.

21. The silver halide color photographic material as claimed in claim 2, wherein coefficient of variation of the grain diameter of said tabular grains having a diameter of at least 0.15 μm is not more than 30%.

22. The silver halide color photographic material as claimed in claim 2, wherein said light-sensitive silver halide emulsion is a silver iodobromide emulsion having a silver iodide content of from 0.1 to 20 mol%.

23. The silver halide color photographic material as claimed in claim 2, wherein the green-sensitive layer is composed of said light-sensitive silver halide emulsion.

24. The silver halide color photographic material as claimed in claim 2, wherein the red-sensitive layer is composed of said light-sensitive silver halide emulsion.

25. The silver halide color photographic material as claimed in claim 2, wherein at least 50% (by number) of said all silver halide grains are tabular grains in which b/a is at least 5.

26. The silver halide color photographic material as claimed in claim 2, wherein at least 70% (by number) of said all silver halide grains are tabular grains in which b/a is at least 5.

27. The light-sensitive silver halide emulsion as claimed in claim 1, wherein at least 50% (by number) of all of said silver halide grains are tabular grains in which b/a is at least 5.

28. The light-sensitive silver halide emulsion as claimed in claim 1, wherein at least 70% (by number) of all of said silver halide grains are tabular grains in which b/a is at least 5.

* * * * *